US005825382A

United States Patent [19]

Thiel

[11] Patent Number: 5,825,382

[45] **Date of Patent: *Oct. 20, 1998**

[54] EDGE-SHOOTER INK JET PRINT HEAD AND METHOD FOR ITS MANUFACTURE

[75] Inventor: Wolfgang Thiel, Berlin, Germany

[73] Assignee: Francotyp-Postalia AG & Co., Birkenwerder, Germany

[ * ] Notice: The term of this patent shall not extend beyond the expiration date of Pat. No. 5,592,203.

[21] Appl. No.: 350,326

[22] Filed: Dec. 5, 1994

Related U.S. Application Data

[63] Continuation-in-part of Ser. No. 101,449, Aug. 2, 1993, Pat. No. 5,592,203.

[30] Foreign Application Priority Data

Jul. 31, 1992 [DE] Germany ..... 42 25 799.8

[51] Int. Cl.[6] ..... B41J 2/045

[52] U.S. Cl. ..... 347/40; 347/71

[58] Field of Search ..... 347/71, 40, 42, 347/68, 94, 20, 54

[56] References Cited

U.S. PATENT DOCUMENTS

| | | | |
|---|---|---|---|
| 3,988,745 | 10/1976 | Sultan | 347/71 |
| 4,092,166 | 5/1978 | Olsen et al. | 96/38.2 |
| 4,216,477 | 8/1980 | Matsuda et al. | 347/70 |
| 4,367,480 | 1/1983 | Kotoh | 347/71 |
| 4,380,771 | 4/1983 | Takatori | 347/43 |
| 4,394,670 | 7/1983 | Sugitani et al. | 347/65 |
| 4,412,224 | 10/1983 | Sugitani | 347/65 |
| 4,525,728 | 6/1985 | Koto | 347/70 |
| 4,536,097 | 8/1985 | Nilsson | 347/68 |
| 4,609,427 | 9/1986 | Inamoto et al. | 156/633 |
| 4,680,595 | 7/1987 | Cruz-Uribe et al. | 347/71 |
| 4,703,333 | 10/1987 | Hubbard | 347/71 |
| 4,752,788 | 6/1988 | Yasuhara et al. | 347/71 |
| 4,769,654 | 9/1988 | Tanaka et al. | 347/71 |
| 4,897,903 | 2/1990 | Johannsen | 347/71 |
| 4,905,017 | 2/1990 | Sugitani et al. | 347/65 |
| 5,028,514 | 7/1991 | Johannsen | 430/320 |
| 5,592,203 | 1/1997 | Thiel et al. | 347/40 |

FOREIGN PATENT DOCUMENTS

| | | |
|---|---|---|
| 0 013 095 | 7/1980 | European Pat. Off. . |
| 0 067 653 | 12/1982 | European Pat. Off. . |
| 0 067 889 | 12/1982 | European Pat. Off. . |
| 0 090 663 | 10/1983 | European Pat. Off. . |
| 0 326 804 | 8/1989 | European Pat. Off. . |
| 0 326 568 | 8/1990 | European Pat. Off. . |
| 0486 256 | 5/1992 | European Pat. Off. . |

(List continued on next page.)

OTHER PUBLICATIONS

IBM Techn.Discl. Bulletin vol. 20,No.3,Aug. 1977, pp. 1193–1195, "Wafer Sepration Into Nozzle Plates by . . . ".

Patent Abstract of Japan No. JP 59–229347 (Kawamura) Dec. 22, 1984.

Patent Abstract of Japan No. JP 2–92644 (Narita) Apr. 3, 1990.

Patent Abstract of Japan No. JP 61–225060 (Yamada), Oct. 6, 1986.

*Primary Examiner*—David F. Yockey

*Attorney, Agent, or Firm*—Herbert L. Lerner; Laurence A. Greenberg

[57] ABSTRACT

An edge-shooter ink-jet print head has a row of nozzles extending in the z-direction on the edge of a head module. The print head includes members into which chambers are formed which, in turn, are equipped with devices for ejecting ink from each chamber to respectively assigned ink nozzles. The ink jets are expelled in the x-direction. The print head comprises a plurality of plates stacked in the y-direction. The ink paths are of equal length at least within each module. In a preferred embodiment, the row of nozzles is formed in an additional part which is also a chamber carrying part. After the production of various module plates by parallel processing of a glass plate, including the formation of cavities of a defined depth by etching and fine grinding, the parts are separated and then joined to form a module. Conductor tracks and PZT elements are provided.

27 Claims, 17 Drawing Sheets

FOREIGN PATENT DOCUMENTS

| | | |
|---|---|---|
| 0 575 204 | 12/1993 | European Pat. Off. . |
| 0 581 395 | 2/1994 | European Pat. Off. . |
| 2 349 555 | 11/1974 | Germany . |
| 26 49 970 | 5/1978 | Germany . |
| 27 52 378 | 6/1978 | Germany . |
| 29 18 737 | 11/1979 | Germany . |
| 32 00 388 | 12/1982 | Germany . |
| 32 22 133 | 12/1982 | Germany . |
| 32 48 087 | 7/1983 | Germany . |
| 34 45 761 | 6/1985 | Germany . |
| 37 10 654 | 10/1988 | Germany . |
| 38 03 432 | 8/1989 | Germany . |
| 38 05 279 | 8/1989 | Germany . |
| 38 14 720 | 11/1989 | Germany . |
| 33 22 647 | 3/1990 | Germany . |
| 31 50 109 | 2/1991 | Germany . |
| 40 25 193 | 2/1992 | Germany . |
| 42 07 626 | 9/1993 | Germany . |
| 42 25 799 | 2/1994 | Germany . |
| 59-229347 | 12/1984 | Japan . |
| 620 662 | 12/1980 | Switzerland . |
| 1 416 980 | 12/1975 | United Kingdom . |
| 92/09111 | 5/1992 | WIPO . |

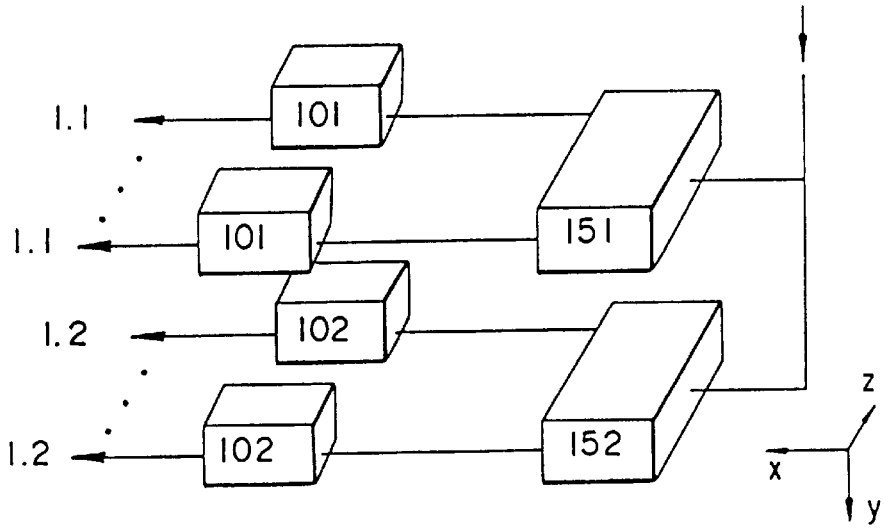
PRIOR ART Fig. 1a
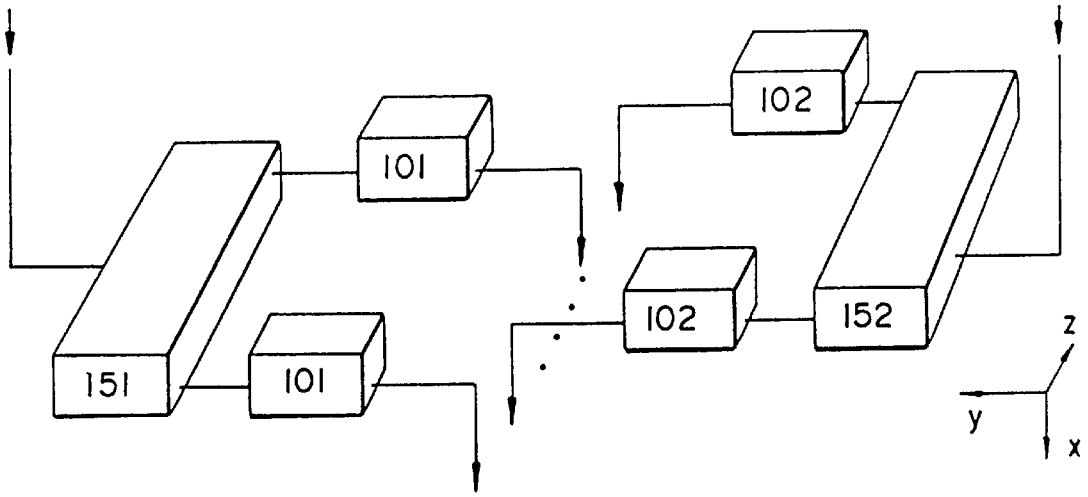
PRIOR ART Fig. 1b

Fig. 5a
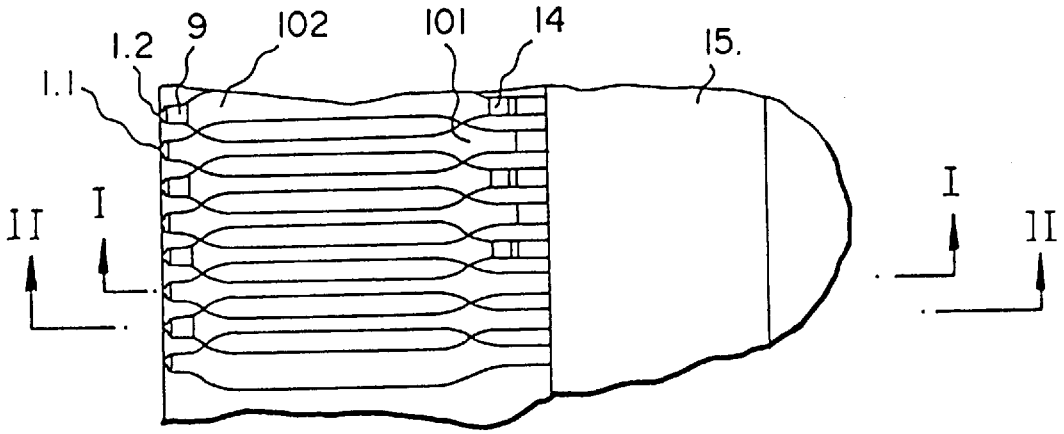
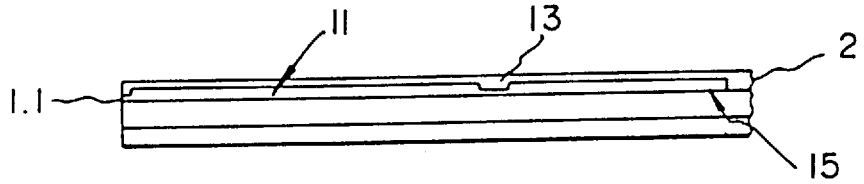
Fig. 5b
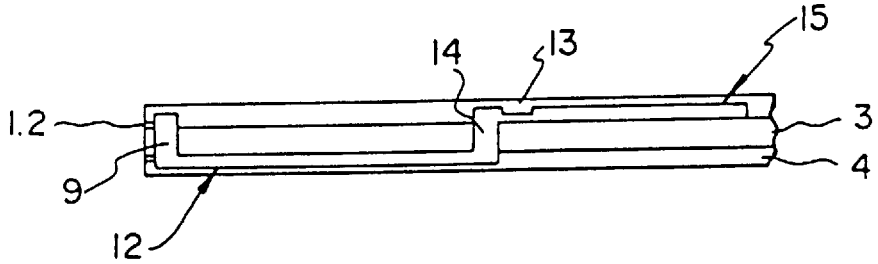
Fig. 5c

| | |
|---|---|
| UV = EXPOSURE<br>THERMAL DEVELOPMENT<br>UV = EXPOSURE | UV PROCESSING |
| MASKING OF PLATES<br>ETCHING OF CONTINUOUS BOREHOLES<br>SEPARATION OF COMPONENT PARTS | PARALLEL PROCESSING |
| SURFACE POLISHING<br>MASKING OF SURFACES WHICH SHOULD NOT BE SUBJECTED TO DEEP-ETCHING<br>DEEP-ETCHING OF INK CHAMBERS<br>POLISHING OF THE INK NOZZLES<br>ETCHING OF THE INK NOZZLES | CONSTRUCTION OF THE INK CHAMBERS IN COMPONENT PARTS |
| ALIGNING AND STICKING TOGETHER<br>TEMPERING, PHASE TRANSFER FROM AMORPHOUS TO CRYSTALLINE | CONNECTION OF COMPONENT PARTS WITH THE MODULE |
| NOZZLE PEAK CUT OFF<br>SUBSEQUENT POLISHING<br>HYDROPHOBIC EXTERNAL COATING<br>HYDROPHOBIC INTERNAL COATING<br>HARDENING OF COATING | CONSTRUCTION OF THE NOZZLES |
| MOUNTING OF ELECTRICAL TRACKS<br>STICKING OF PIEZOELECTRIC CRYSTALS<br>HARDENING | BONDING |
| NOZZLE CLEANING BY MEANS OF COMPRESSED AIR<br>MOUNTING OF MODULES, CONNECTION, PUSH-BUTTON TEST | ASSEMBLY |

Fig. 8b

EDGE-SHOOTER INK JET PRINT HEAD AND METHOD FOR ITS MANUFACTURE

CROSS-REFERENCE TO RELATED APPLICATION

This is a continuation-in-part of application Ser. No. 08/101,449, filed Aug. 2, 1993, now U.S. Pat. No. 5,592, 203, which disclosure is herewith fully incorporated.

BACKGROUND OF THE INVENTION

1. Field of the Invention

This invention relates to edge-shooter ink jet print heads, and in particular to an edge-shooter ink jet in-line print head, and a method for manufacturing the print head. Print heads of this kind are preferably used in small, fast printers as they are utilized, for instance, in franking machines for franking postal matter.

2. Description of the Related Art

Ink jet print heads built on the edge-shooter or face-shooter principles (First Annual Ink Jet Printing Workshop, Mar. 26–27, 1992, Royal Sonesta Hotel, Cambridge, Mass.) are known in the art. So far, efforts have been made to minimize chamber dimensions in an effort to increase nozzle density. Also, nozzle chambers have been arranged concentrated to the face edge. However, this principle is useful only for ink jet modules with few nozzles in one row and they fail when there is a high number of nozzles or a high packing density.

In a first generation of ink jet print heads, the same were built according to the edge-shooter principle of single impulse jets which comprise an elongated ink chamber with a rectangular cross-section and a piezo crystal located thereabove (BIS CAP Ink Jet Printing Conference, Monterey, Calif., Nov. 11–13, 1991). In a later generation, a nozzle panel was disposed in front of a one piece ink jet print head with several chambers. In that case, the chambers do not lie in parallel and side by side with the smaller chamber surface but with the larger chamber surface. Piezo crystals thereby form the chamber walls. This is referred to as the "shared wall concept" (Ink Jet Printing Conference, Nov. 11–13, 1991).

Ink-jet print heads that have been further developed according to the face-shooting principle, as are described, for example, in U.S. Pat. Nos. 4,730,197, 4,703,333, 4,695, 854, 4,635,079, 4,641,153 and 4,680,595, consist of ink chambers that are arranged to the right and left of a line of nozzle outlet openings, orthogonally to the longitudinal axes of the ink chambers. The ink chambers lie with all their longitudinal axes in one plane. In this configuration, too, the density that can be achieved in the arrangement of the nozzles is determined by the width of the chambers and by the thickness of the partition walls that lie between two chambers which, because of the cross-talk effect, cannot fall below a specific minimum. The arrangement on both sides of and symmetrical to the line of nozzles, only brings about a two-fold increase in the jet density. Up to the present time, geometrical resolutions of 64 dpi have been achieved with configurations of this kind. This solution is inadequate for printing graphic symbols of the kind required, for example, for label printers or franking machines. In the case of known arrangements, the chamber size beneath the PZT-elements (leadzirconate-titanate elements) is restricted by width and a high level of nozzle density cannot be achieved.

Moreover, from U.S. Pat. No. 4,680,595 to Cruz-Uribe et al., there is known a face-shooter type print head which has a doubled nozzle density with two groups of ink chambers. A chamber plate that forms the chambers in a symmetrical configuration relative to the jet line is produced and a membrane plate is subsequently positioned thereon. A single PZT layer is secured above the membrane plate, and subsequently separated into discrete PZT elements by the removal of material. Next, the membrane plate is positioned and secured over the chamber plate, beneath which there are a number of additional working plates.

Each print chamber is rectangular in cross section and includes a supply channel and a nozzle as well as an oscillation plate with a piezo-ceramic element. However, this print head is disadvantageous in that pressure waves occurring in the ink supply and in each chamber can result in a spillover or cross-talk to other pressure chambers. This spillover may only be eliminated by providing for extensive supplementary safeguards. Another disadvantage is that these ink jet print heads must be manufactured in an expensive large-scale manufacturing process.

German patent No. DE 34 45 761 A1 also discloses a process for manufacturing a transducer arrangement from a single plate of a transducer material. After coating the lower plate surface with a membrane layer, a removal of material from the upper surface follows, creating separated areas arranged on the membrane above each pressure chamber (area 25.4 mm by 2.54 mm). It is no longer necessary to provide an adhesive connection between the transducer material and the membrane, with the regularity of all distances and spacings being improved. The resulting nozzle distance, however, becomes comparatively large.

From U.S. Pat. No. 4,703,333 to David Hubbard, it is known to produce an ink jet print head from a number of face-shooter modules which are diagonally staggered, one on top the other, resulting in a configuration which is inclined towards the surface of a recording medium. Ink jet print heads having such an inclined configuration produce a constant recording even if the thickness of the recording medium varies. However, production of such print heads requires a multitude of process steps and it is difficult to guarantee in a large-scale process the accuracy required for each print head arrangement. The electrical control for these print heads during use is a further difficulty. Even with an arrangement of two rows of chambers with nozzles that are offset relative to each other with, in each instance, a lower nozzle density in each row of nozzles, the minimum distance between the nozzles cannot be further reduced because of a required minimum size of the ink chambers.

A doubled nozzle density in a row is achieved in the face-shooter ink-jet module by means of two groups of ink chambers that are disposed symmetrically of the line of nozzles. In the edge-shooter ink-jet print module, an increase in nozzle density has to be achieved in another way. In the solution proposed in U.S. Pat. No. 4,525,728, an edge-shooter ink-jet print module with one row of nozzles per chamber plate is proposed. The dimensions of the chambers and the channels can be further reduced under certain circumstances. Here, the longitudinal axes of the relatively long ink chambers lie in the direction of the ink jet, whereas the width of the ink chambers is greatly reduced. However, the production step required to apply the PZT elements is problematic, for the tolerances that have to be observed are extremely small.

In the above-noted parent application Ser. No. 08/101, 449, we have previously proposed greater imaging density in that a plurality of chambers be offset horizontally and vertically relative to each other. A single row of nozzles for the whole of the module is formed in a part that forms chambers. However, in this, the channels that lead to the nozzles from the lowest plane, which is some distance away, are longer than the channels from the upper, closer plane, and this leads to a phase shift of the individual ink jets, which has to be balanced out electronically. In addition, because of the very long channels, greater forces have to be applied by the piezo crystals so that these may fail earlier than other piezo crystals. A higher nozzle density in the rows of nozzles is the result of a multi-layer construction.

On the other hand, the control energy that is then required for the PZT elements, which moves ink from chambers with a long ink path to the nozzles or ink reservoir, respectively, can no longer be applied using standard driver components.

It is accordingly an object of the invention to provide an ink jet print head and a method for manufacturing the same, which overcome the hereinafore-mentioned disadvantages of the heretofore-known devices and methods of this general type and to provide an ink jet print head with a high nozzle density per row and a manufacturing process for the print head with low production costs. More particularly, it is an object to provide a compact ink-jet print head for high-resolution printing.

SUMMARY OF THE INVENTION

With the foregoing and other objects in view there is provided, in accordance with the invention, an ink jet print head of the edge-shooter type, which comprises:

first and second chamber-carrying members each having a plurality of ink chambers for receiving ink formed in a flat surface thereof, and the first chamber-carrying member having nozzle openings formed therein each being assigned to a respective one of the ink chambers;

a center member disposed between the flat surfaces of the first and second chamber-carrying members;

means for supplying ink to the ink chambers and for ejecting ink from the ink chambers through the nozzles;

the nozzles formed in the first chamber-carrying member forming a single nozzle row having k nozzle groups and extending in a first direction, the ink chambers having k chamber groups with each of the nozzle groups being associated with a respective one of the chamber groups; where $k \geqq 2$;

the ink chambers formed in the first chamber-carrying part being a first chamber group and the ink chambers formed in the second chamber-carrying member being a k−1th chamber group, a first nozzle group of the k nozzle groups communicating with the first chamber group, and a k−1th nozzle group of the k nozzle groups communicating with the k−1th chamber group;

the nozzle openings extending and ejecting ink droplets in a second direction being substantially orthogonal to the first direction, the k chamber groups being disposed in a third direction relative to one another, the third direction being substantially orthogonal to the first and second direction;

the center member having communication openings formed therein, the communication openings being associated and cooperating with the ink supplying means for supplying the k−1th nozzle group in the nozzle row with ink.

The surfaces of the chamber-carrying members in which the ink chambers are formed each face the center member. The respectively orthogonal directions, i.e. the first, second and third directions may be described in a cartesian system with x, y and z directions.

The improvements with regard to the instant disclosure are specifically directed to reducing problems that occur when a plurality of planes are to be set up one above the other. It is true that a cross-talk effect between the planes could be reduced by arranging a sufficiently thick spacer layer between the planes. On the one hand, however, it is not possible to stack any large number of planes in this way, because triggering energy which could not be applied by conventional driver circuits would be required for the additional planes. On the other hand, the resistance that the flow of ink would have to overcome on its path to the nozzles cannot be reduced by simple changes in geometry. In this connection, the problem of gas generation becomes troublesome. Pressure differences, and sometimes air bubbles, would be formed between the topmost and the lowest groups of chambers, i.e., planes that are spaced apart relatively far vertically, in the case of increased triggering energy, and ultimately these prevent clean printing.

These problems are clearly overcome with the configuration as described herein. There is provided, in accordance with the invention, a configuration in which at least one module is so configured with ink channels that run in a number of planes that ink paths of almost identical length are formed. Beneath a first plane, in which a first group of ink chambers lies in a first part that forms chambers, a part that forms additional chambers is disposed in a second plane with an additional group of ink chambers such that the ink chambers of the second plane are offset from the first plane both vertically and horizontally, relative to the nozzle line. Provision is made such that in at least one additional plane between the middle part and the first part that forms the chambers, or between the middle part and a part that forms additional chambers, there is a part that forms additional chambers according to the present invention, the nozzle row being formed only in some of the parts that form the chambers that are additionally incorporated. The chamber groups are so displaced relative to each other in the x, y and z directions that the ink path from the suction chamber in the part that forms the first chambers or from the part that forms the additional chambers the nozzles of the nozzle group in the nozzle row is configured to be of equal length, at least within a module.

The ink path lengths, which are configured differently because of the vertical space between the planes in the y direction, are thus balanced out by a defined ink-channel length in the planes. In particular, the chambers to the nozzle row on the one hand, and to a suction chamber on the other, are so arranged that, in each plane there are ink channels of different lengths, in particular, nozzle channels and inlet channels and, in the parts that form the additional chambers, there are transit channels, and the sum of all the ink-channel lengths associated with each chamber remains almost constant.

The present invention proceeds from the fact that because of the solution according to the present invention, with ink chambers offset horizontally and vertically, it is possible to achieve a greater nozzle density, relatively independently of the dimensions of the ink chambers, for an edge-shooter ink-jet print head. Provision is made such that in the nozzle row, the nozzles that belong to different nozzle groups alternate in such a manner that the overlap of chamber groups of one plane is effective with those of the other planes only at the edges of the chambers.

In a manner comparable to my previously disclosed invention, the ink chambers of additional planes can be connected with the associated nozzle groups through transit channels. Thus, nozzles are supplied with ink from the ink chambers of other planes which are, in their turn, disposed between those nozzles which are supplied from the ink chambers of the first plane, and form a dense line of equidistant nozzles in the x direction with these. On the other hand, differences in the lengths of the ink paths, which would lead to a distorted print image, are compensated.

In a preferred embodiment it is provided that the ink-jet print head is made up of only one module that conchins chambers arranged in at least two chamber plates. The distance to the nozzle line is thereby bridged by channels that lie within the volume of the module and in part between the chambers.

In each instance, the nozzle channels from the chambers to the nozzles, on the one hand, display a defined and equal first flow resistance and, in each instance, the inlet channels from the suction chamber to the chambers, on the other hand, display a defined equal second flow resistance. This can be achieved in that the channels pass through more planes in the vertical direction to the chambers or to the nozzles, respectively, with all the channels of one type being of equal length, with an equal cross-section. Each of the nozzle channels has a defined lower first flow resistance than each inlet channel. This can also be achieved additionally by selective cross-sectional changes and/or turns in the horizontal direction.

In addition to the greater nozzle density, a further advantage is found in the smaller effect of tolerances, i.e. inaccuracies in structure. This is so because the individual planes of the multi-level construction do not have to be off-set relative to each other.

With the above-noted and other objects in view, there is also provided, in accordance with the invention, a method of manufacturing an ink jet print head which comprises the steps of: processing plate material in parallel, i.e. simultaneously, and forming through openings in all members to be equipped with through openings; forming chamber-carrying members; connecting the members and forming at least one print head module, and subsequently annealing the at least one print head module; applying piezo-electrical elements to the at least one module and connecting the piezo-electrical elements with conductor paths applied to the module; and assembling the at least one module to form an ink jet print head.

In other words, the method may be broadly described as parallel plate processing in production of through openings in all parts, special processing of chamber-carrying parts, arranging the components as at least one module with subsequent annealing, applying and bonding the piezo-electrical elements with applied conductor paths, and assembling as the print head.

Based on an objective to produce ink jet print heads with an arrangement inclined towards the surface of a recording medium to generate a steadier recording even if the thickness of the recording medium varies, an ink jet print head having an in-line module with edge-ejection of ink droplets is preferred.

The invention proceeds on the recognition that, with the principle of edge-ejection, the nozzle row with a high number of nozzles, may be formed in a side part or component of a print head module. For the first time, a higher nozzle density, completely independent of the ink chamber dimensions, may now be achieved.

In fact, the ink chamber dimensions may even be increased without decreasing the nozzle density.

In addition to the increased nozzle density, the print head according to the invention provides a number of further advantages. In the following, the print head according to the invention will be referred to as the Edge-Shooter-Ink-Jet-In-Line print head or the ESIJIL print head.

By having all of the nozzles formed in one and the same glass part, it is possible to obtain a steady nozzle size and steady spacing between all nozzles. This is due to the fact that respective channels for the nozzles are etched into the same glass part. That part forms the side member or lateral member of the print head module, before a diffusion bonding process takes place. Due to the fact that nozzle openings need be formed only in one member, manufacturing costs are logically reduced.

In contrast with conventional edge-shooter print head configuration, in which two rows of nozzles are horizontally aligned, an overlapping of the chamber-carrying members (each carrying a group of laterally offset ink chambers) is possible with a much greater machining tolerance.

A vertical alignment of the member with the ink nozzles and the chamber-carrying parts (each with a group of laterally offset chambers) is uncritical, as all nozzles are formed only on the one part of the print head module. This, again, reduces manufacturing costs.

The single nozzle row disposed at the edge facilitates disposing the print head in an inclined position relative to the recording medium.

Electrical control of the ink jet print head can be performed in a simpler way as compared to the prior art, because it is not necessary to compensate for the nozzle row spacing by chronologically offsetting print control signals.

In several embodiments of the invention, the ink jet print head may be formed of several modules, with only one module carrying the nozzle row. Alternatively, it may be formed of a module with several members. It is understood that a further advantage is obtained from the novel print head, in that the face edge of that member which has the nozzle row, may be disposed at a side or in the middle of a module.

The inventive method for manufacturing the ink jet print head is based on a print head configuration developed with a CAD (computer aided design) system, and mask production of a photo-sensitive glass plate.

The parts from which the individual members are formed are first sensitized with regard to the etchants which will be used in the etching process. In other words, those areas which are to be removed from the glass plate are first sensitized. The masked glass plates are exposed at least once to a ultraviolet (UV) irradiation with ultraviolet light of appropriate wavelength. This is followed by a heat treatment, which brings about a phase change in the irradiated areas, which can be better etched than the non-irradiated areas.

In a subsequent process, the areas that are to be removed are etched out of each plate in order to form cavities. The duration of the etching bath determines the thickness of the layer of material removed. The layer thickness of the membrane that remains during etching is monitored. When a specified layer thickness is reached, the surface is processed by means of fine grinding, or a defined membrane thickness is set up, respectively.

After production of the different module plates by parallel processing of glass plates, including the formation of cavities of a defined depth by etching and fine grinding, separation is carried out and the individual parts are joined to form a module that is provided with printed conductor tracks and PZT elements.

In each instance, three individual parts, consisting of two chamber parts and consisting of at least one additional plate, which simultaneously serves as a separator, are oriented and cemented to each other, and then finally tempered or passed through the diffusion-bond process. The plates are provided with conductor tracks for the PZT elements that are to be installed next. Finally, there is a special processing of the nozzle channels and the cavities (chambers) and of the nozzle plate of the module before the print head, together with the driver circuits, is provided with contacts, finished and installed.

Finished modules can be connected through an adhesive layer as part of an assembly process. A print module can be completely assembled to form a print head either individually or with a second print module that is built up, in principle, as a mirror image.

Referring now specifically to the disclosure of this CIP application, there is also provided, in accordance with a further feature of the invention, an edge-shooter ink-jet print head, comprising a head module defining mutually orthogonal x, y and z directions and having nozzles formed in an end face thereof for expelling ink in the x-direction, the head module being formed of a plurality of plates stacked one upon another in the y-direction, the plates including:

a first ink chamber carrying part having ink chambers formed therein for receiving ink, the nozzles communicating with the ink chambers through conduits and the nozzles being mutually aligned on the end face in a nozzle row extending in the z-direction;

a middle part disposed on the ink chamber carrying part;

a second ink chamber carrying part disposed between the first ink chamber carrying part and the middle part; the nozzle row being formed in the second ink chamber carrying part;

the ink chambers formed in the ink chamber carrying parts forming groups of ink chambers; the groups of ink chambers being offset relative to one another in the x, y, and z-directions for forming ink paths from the suction chambers to respectively associated ones of the nozzles having a substantially uniform length within each of the modules; and means for supplying through the chambers and expelling ink from the nozzles.

In accordance with another feature of the invention, the nozzles in the nozzle row belong to given nozzle groups, the nozzles of different nozzle groups alternating with one another such that the ink chambers of one plate overlap the ink chambers of another plate in the y-direction only at chamber edges thereof.

In accordance with an additional feature of the invention, the ink chambers are disposed relative to the nozzle row and relative to the suction chamber for forming ink channels of varying lengths in each plane of the module, the conduits being formed of nozzle channels, inlet channels and transit channels in the second ink chamber carrying parts, a sum of the lengths of ink channel for each chamber remaining substantially constant.

In accordance with an alternative feature of the invention, the ink-jet print head is formed of at least two modules, the middle parts of each of the head modules being disposed on one another, the ink chamber carrying parts each defining a given ink chamber formation, the ink chamber formation in the second ink chamber carrying part being oriented either opposite or in the same direction as the ink chamber orientation in the first ink chamber carrying part.

In accordance with another feature of the invention, the middle parts of each of the head modules are spacers and are joined to one another with an adhesive layer; and the print head includes at least one additional separator plate having a given thickness disposed between the first and second ink chamber carrying parts, the additional separator plate defining an offset in the x and y-directions between adjacent ones of the first and second ink chamber carrying parts.

In accordance with a further feature of the invention, the offset in the x, y, and z-directions is so formed that an ink path length within adjacent head modules is substantially equal, the adhesive layer having openings formed therein defining transit channels through the middle part and to the nozzles of nozzle groups in the second ink chamber carrying part.

In accordance with yet a further feature of the invention, the ink-chambers in various planes overlap one another and define an area of overlap, and including additional ink conduits formed in the head module for minimizing the area of overlap.

With the above and other objects in view, there is provided a method of manufacturing an edge-shooter ink-jet print head, which comprises: a) parallel processing of a glass plate for forming different module plates of an ink-jet print head and forming cavities of defined depth in the glass plate; b) subsequently separating individual parts for the ink-jet print head from the glass plate; c) joining the individual parts by diffusion bonding and forming a module of the ink-jet print head; d) depositing conductor tracks on the glass plate and installing PZT elements or a PZT layer; e) assembling the print head module to form a print head, cleaning nozzles formed in the printhead by means of compressed air, applying a hydrophile inner coating on nozzle channels, applying a hydrophobic outer coating on a face edge of the module, providing driver circuits for the print head, providing supply means necessary for a functionality of the print head, placing the print head into a housing, and testing the print head for proper operation.

In accordance with another mode of the invention, steps a) through d) are performed simultaneously for two mutually associated print head halves; the method further comprises assembling each of the print head halves, cementing the print head halves together with an adhesive layer, cleaning channels of the print head of adhesive in a liquid cleaning process and utilizing a solvent which is not a solvent for a print head ink; and cleaning the channels by means of compressed air prior to the step of providing supply means.

In accordance with an additional mode of the invention, the method further comprises forming the adhesive layer from an adhesive which can be dissolved with a solvent prior to hardening thereof.

In accordance with yet another mode of the invention, the method further comprises: applying the adhesive layer to at least one half of the print head as a self-adhesive foil, removing adhesive material from the foil by means of a laser beam forming opening transit openings to the channels, the channels leading through separators to the ink jet nozzles; and, after joining the two print head halves together, hardening the adhesive layer by supplying energy thereto.

In accordance with a concomitant mode of the invention, the method further comprises adjusting the hardening step by controlling the energy supply with regard to time and location such that channels leading to the print head nozzles are not blocked off by adhesive from the adhesive layer and that any possible stoppage cannot harden so quickly as to disallow a removal thereof with an adhesive solvent.

Other features which are considered as characteristic for the invention are set forth in the appended claims.

Although the invention is illustrated and described herein as embodied in an ink jet print head and a method for its manufacture, or the edge-shooter ink jet in-line (ESIJIL) print head, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWINGS

FIG. 1*a* is a schematic, three-dimensional block view of a prior art edge-shooter ink jet print head;

FIG. 1*b* is a similar view of a prior art face-shooter ink jet print head;

FIG. 5*a* is a partial, more detailed and magnified view of the ESIJIL print head of FIG. 4;

FIG. 5*b* is a sectional view taken along the line I—I of FIG. 5*a;*

FIG. 5*c* is a sectional view taken along line II—II of FIG. 5*a;*

FIGS. 8*a* and 8*b* are is a flow chart of the process for manufacturing the ESIJIL print head according to the invention;

DESCRIPTION OF THE PREFERRED EMBODIMENT

Figure 1C:
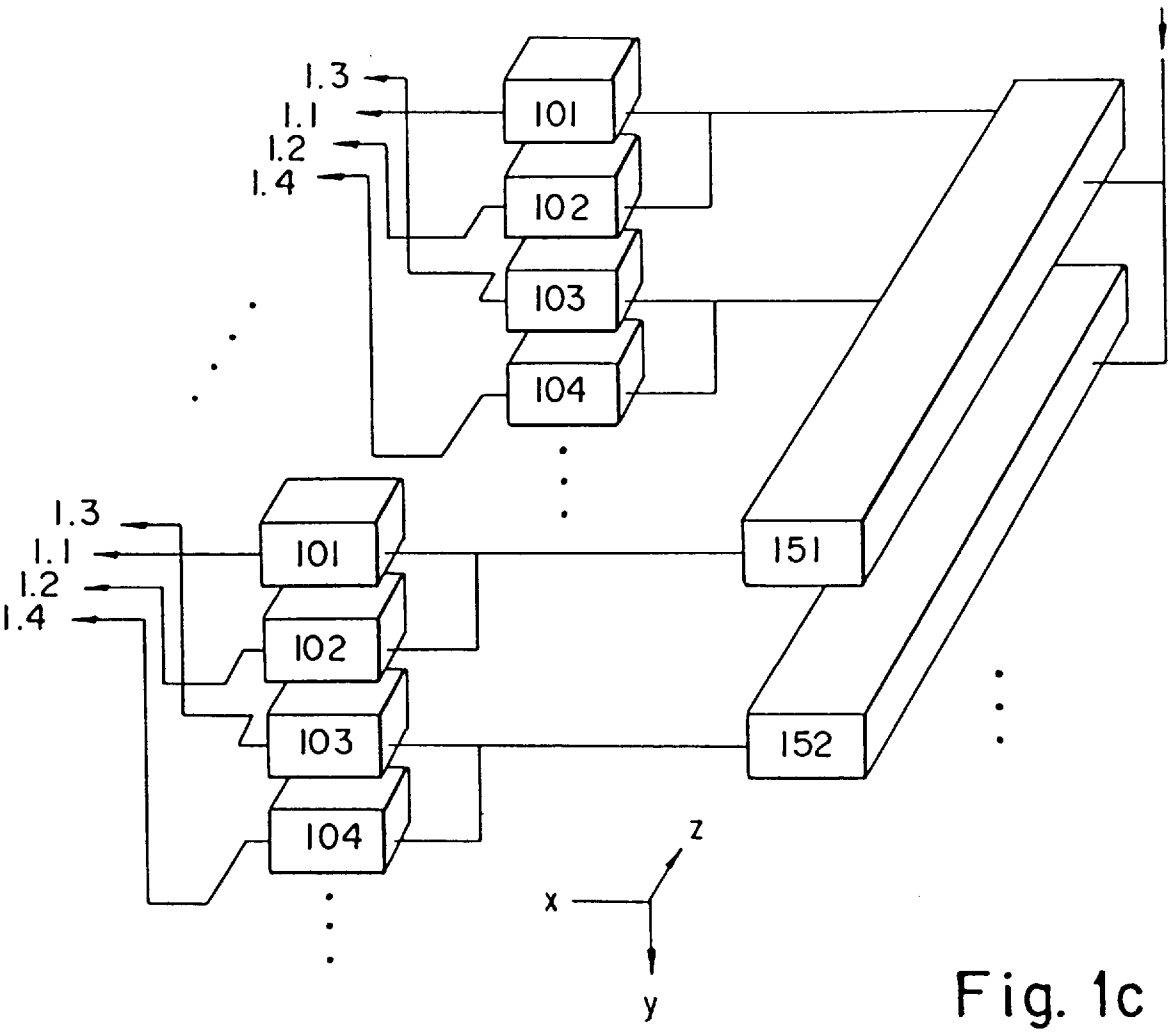
FIG. 1*c* is a similar view of an edge-shooter ink jet in-line (ESIJIL) print head in accordance with the invention.

The term "X-ray view" in the foregoing brief description of the drawings and in the following description refers to a two-dimensional projection through a body in which interior features are outlined and shaded which are not normally visible from the outside of the body.

Referring now to the figures of the drawing in detail and first, particularly, to FIG. 1*a* thereof, there is seen a perspective illustration of the well-known principles of an edge-shooter ink jet print head. The edge-shooter, in a modular configuration, includes an edge at which there lie two rows of nozzles 1.1 and 1.2. The nozzles 1.1 and 1.2 are vertically offset in the y-direction. As shown, a first group of ink chambers 101 are coupled to the group of nozzles 1.1 in the first row and a second group of ink chambers 102 are connected to the nozzles 1.2 of the second row.

FIG. 1*b* illustrates the well-known principles of a face-shooter ink jet print head. The modular configuration includes a base with a single row of nozzles formed from two groups of nozzles 1.1 and 1.2 which are horizontally disposed in an alternating fashion in the z-direction. A nozzle 1.1 is followed by a nozzle 1.2, which in turn is adjacent another nozzle 1.1, etc. Suction chambers 151 and 152 are operatively connected to respective groups of ink chambers 101 and 102 which in turn communicate with the two nozzle groups 1.1 and 1.2, respectively, for supplying ink thereto.

With reference to FIG. 1*c*, the print head according to the invention is referred to as an Edge-Shooter-Ink-Jet-In-Line (ESIJIL) print head. Its modular configuration includes a single row of nozzles formed along an edge thereof (i.e. print edge). The single row of nozzles is formed from $k \geqq 2$ nozzle groups 1.1, 1.2, etc., with the nozzles being disposed in a horizontal sequential order in the z-direction. The print head is configured such that flow from ink chamber groups 101–104 (where k=4) is guided to a first region of the print head in which the nozzles are disposed. That region forms a side part of the print head structure. The groups of ink chambers 101–104 are displaced in the y-direction. A conduit guides ink from each of the chambers 101–104 to the print edge, to the nozzles 1.1–1.4, which are disposed in one row and which are spaced apart with only small spacing therebetween.

In the embodiment illustrated in FIG. 1*c*, respective ink chambers of the groups 101–104 are in vertical alignment. The supply of ink to the nozzles is effected by staggering the guide channels in the z-direction. In another, non-illustrated embodiment, the chambers 101–104 themselves may be laterally offset in the z-direction. The aligned ink chamber configuration finally results in the desired number of nozzles in one row. While FIG. 1*c* illustrates only two such sub-assemblies, it is understood that this is only done for reasons of clarity. The lateral distance between adjacent nozzles here is much smaller than the lateral distance between neighbouring chambers within each group. In use, ink droplets are ejected or shot out from the nozzles in the x-direction. The x, y and z directions in the drawings refer to an orthogonal system, i.e. the carthesian axes are perpendicular to one another. Also, the addition of further ink chambers 105, 106, etc. in the y-direction is possible in principle and merely limited by economic factors. The inventive principle provides its positive effect, namely the formation of a single row of nozzles having minimum spacing therebetween, even with only two chamber groups 101 and 102.

Figure 2:
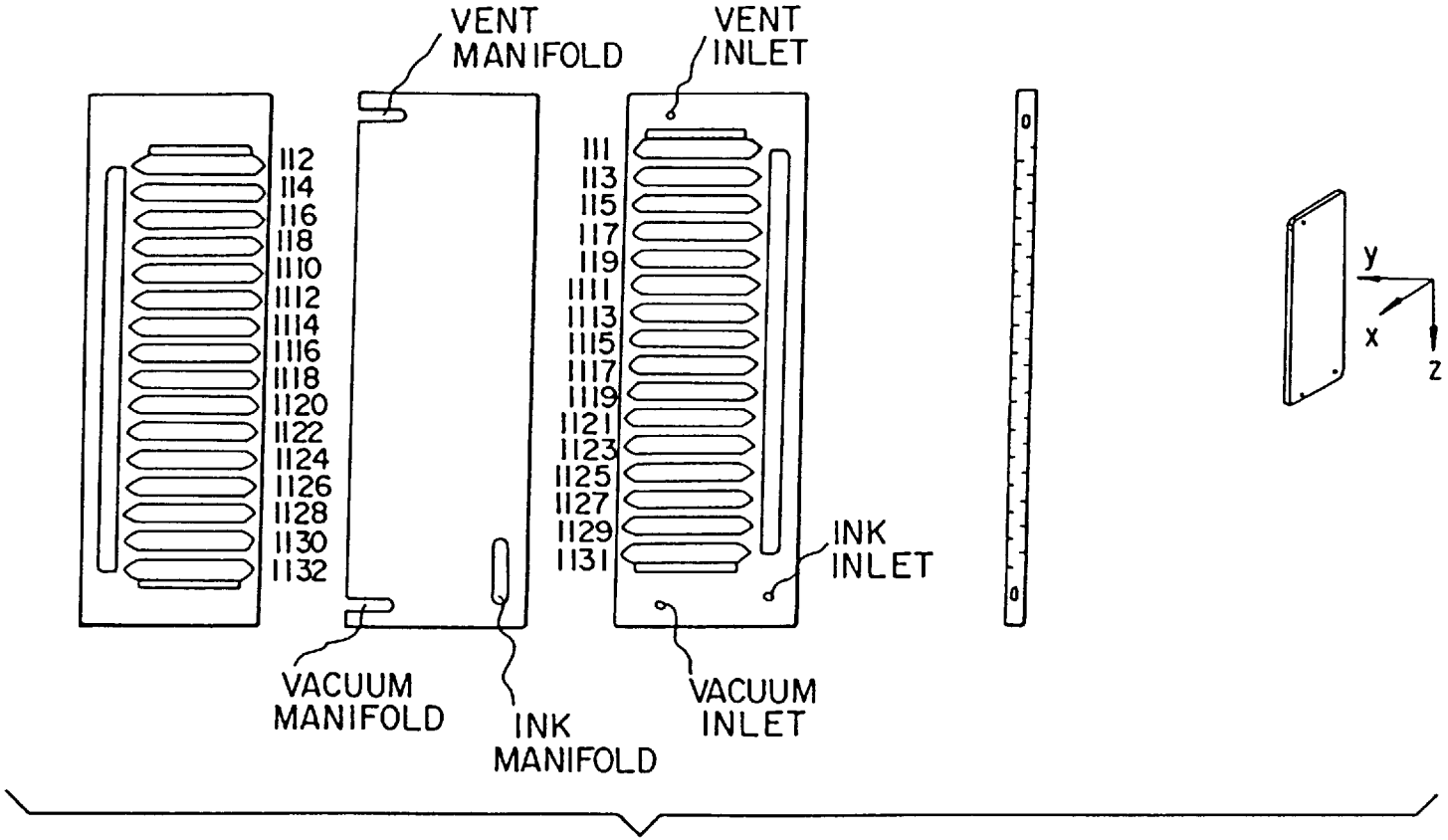
Fig. 2 PRIOR ART
FIG. 2 is a diagrammatic, exploded view of a prior art edge-shooter ink jet print head configuration.

Referring now to FIG. 2, a conventional two-row edge-shooter ink jet module configuration consists essentially of three members typically made from ceramic or glass. A first member, which carries a first group of ink chambers on its left-hand side, is connected in the y-direction to a second member, which carries a second group of chambers on its right-hand side. A middle member is sandwiched in between. The alignment is such that the ink chambers are disposed inward facing the middle member and they are staggered in the z-direction along a longitudinal edge. Each chamber is connected to a suction chamber through a first channel and to the face edge of the module through a second channel. Each of the second channels form a nozzle. It is rather difficult to keep the distances between the nozzles of the two rows exactly the same and any differences will produce deviations in the print image through constant timed selection of nozzles in the two rows. This results in poor print quality. The middle chamber has an opening that connects the suction chambers of the first and second members to one another and to an ink supply opening. Additionally, the members are provided with openings for fastening devices.

Figure 3:
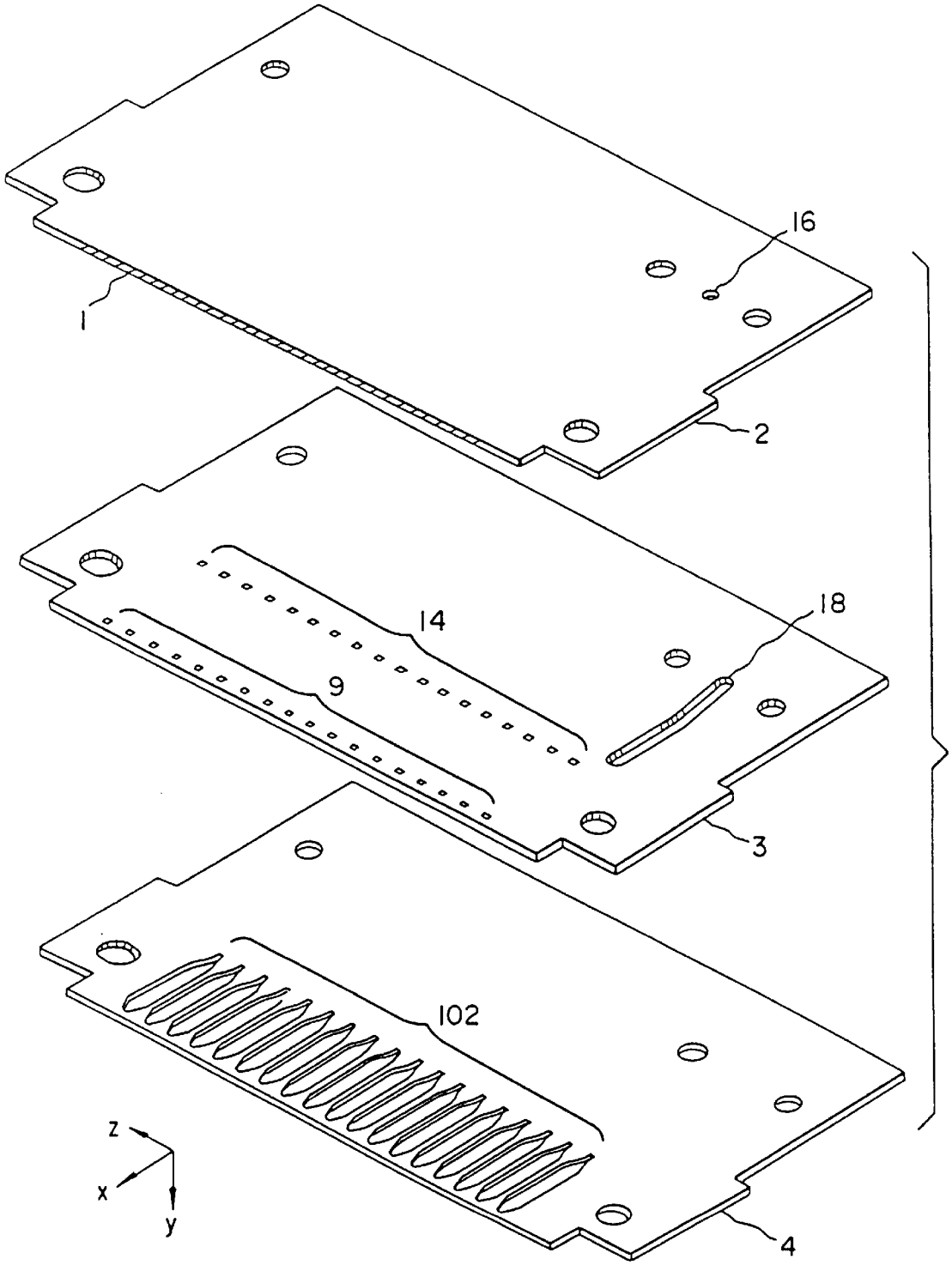
FIG. 3 is an exploded perspective view of a first embodiment of an ESIJIL print head according to the invention.

Referring now to FIG. 3, a module for a first embodiment of the ESIJIL print head (with k=2) consists essentially of three members. A first member 2 carries chambers and all of the nozzles 1. While certain part are referred to as chamber-carrying members, it is understood that they do not "carry" chambers per se, but that chambers or recesses which will form chambers are formed therein. A single row of nozzles 1 is formed. A middle part or center member 3 has a number of second and third openings 14 and 9, in addition to a first opening 18, which effects a communication between the ink supply opening 16 and a suction chamber 15 (not illustrated in FIG. 3). An ink chamber group 101 and the suction chamber 15 are located on the left side of the first member 2, i.e. the underside of 2 which faces the center member 3. A second chamber-carrying member 4 is provided with a second group of ink chambers 102. The ink chambers 102 are supplied with center member 3. Theenings 14 in the center member 3. The center member 3 is not provided with nozzles. Additional nozzles formed in the first member 2 are connected to the ink chambers 102 of the second member 4 via third openings 9 formed in the center member 3. The members 2–4 are assembled by clamping them in the direction of the y-axis.

Figure 4:
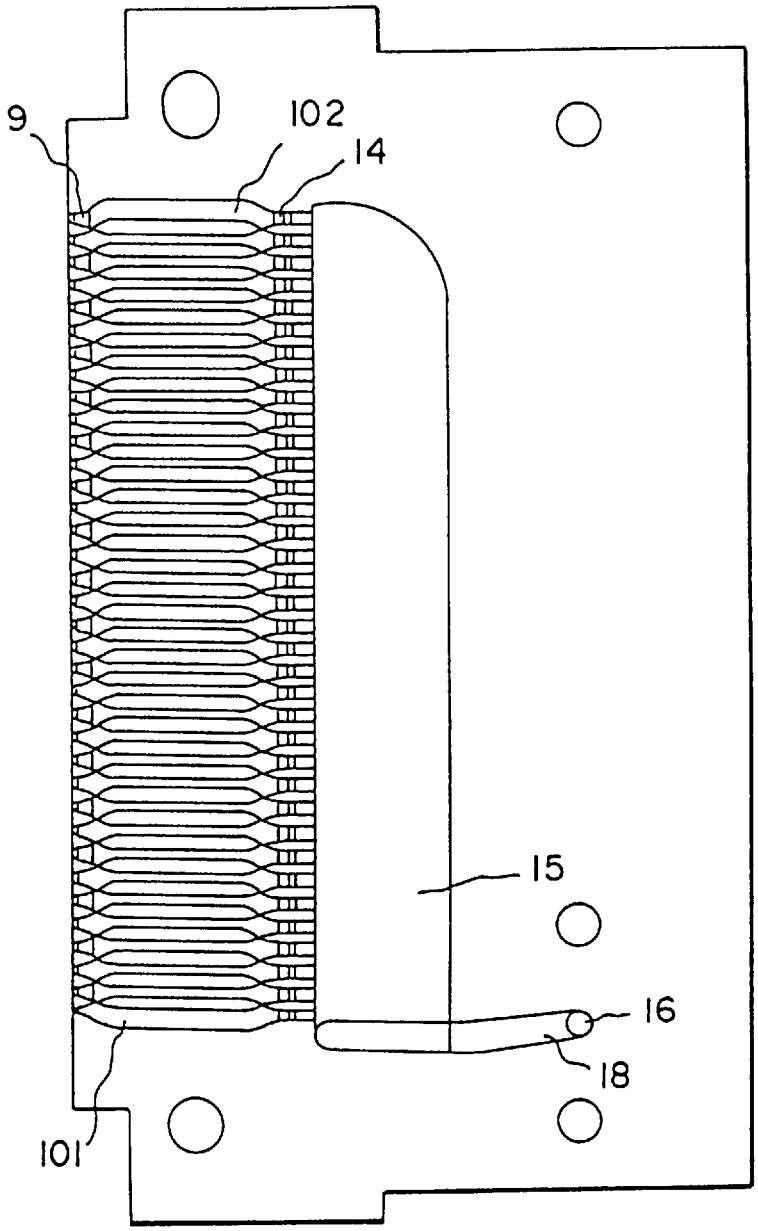
FIG. 4 is a plan X-ray view of the ESIJIL print head of FIG. 3 in an assembled condition.

Referring now to FIG. 4, the X-ray view of the first embodiment of the ESIJIL print head module, in plan view, clearly illustrates the aligned (in-line) configuration of the nozzles and the lateral staggering of the first ink chamber group 101 (formed in the first member 2) relative to the second group of ink chambers 102 (formed in the second member 4). There is also shown the location of the first opening 18 in the center member 3 in communication with the ink supply opening 16 and the suction chamber 15 of the first chamber-carrying member 2. The second openings 14 are connected to the suction chamber 15. The third openings 9 guide the ink to the nozzles of the second nozzle group 1.2. It is provided for the nozzles of the nozzle group 1.1 to alternate with the nozzles of the nozzle group 1.2 within the nozzle row.

Referring now to FIGS. 5*a*–5*b*, in which a detail of the X-ray view of FIG. 4 is magnified, the nozzles in the first chamber-carrying member 2 which are associated with the nozzle group 1.1 are assigned to the ink chambers of the first group 101 formed in the same first member 2. From the suction chamber 15, an ink chamber 11 is supplied with ink via a channel 13 (FIG. 5*b*). The nozzles associated with the second nozzle group 1.2 in the first chamber-carrying member 2 are assigned to the chambers 12 of the second ink chamber group 102. The group 102 is formed in the second chamber-carrying member 4, as more clearly seen in the sectional view in FIG. 5*c*. From the suction chamber 15 formed in the first member 2, ink is supplied to the ink chamber 12 of the second member 4 through another channel 13 and through one of the second openings 14 formed in the center member 3. A communicating connection is provided from each chamber 12 to a respective nozzle of the nozzle group 1.2 formed in the first member 2 through a third opening 9 in the center member 3.

Figure 6D:
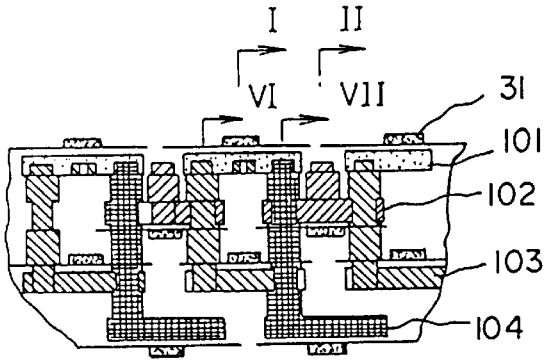
FIG. 6*d* is a sectional X-ray view through the ESIJIL print head of FIG. 6*a;*
Figure 6A:
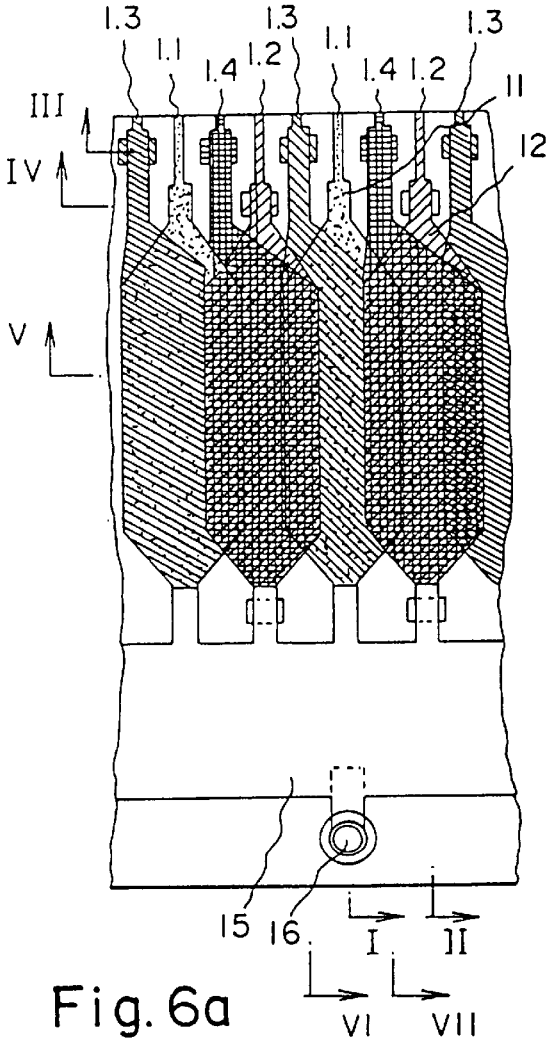
FIG. 6*a* is a partial X-ray view through a second embodiment of the ESIJIL print head according to the invention.
Figure 6B:
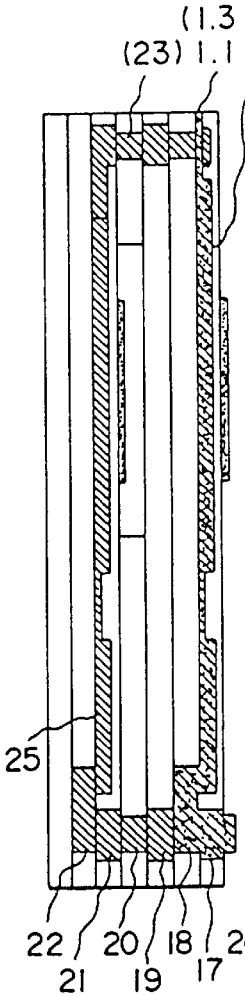
FIG. 6*b* is a sectional view taken along line I—I of FIG. 6*a;*
Figure 6C:
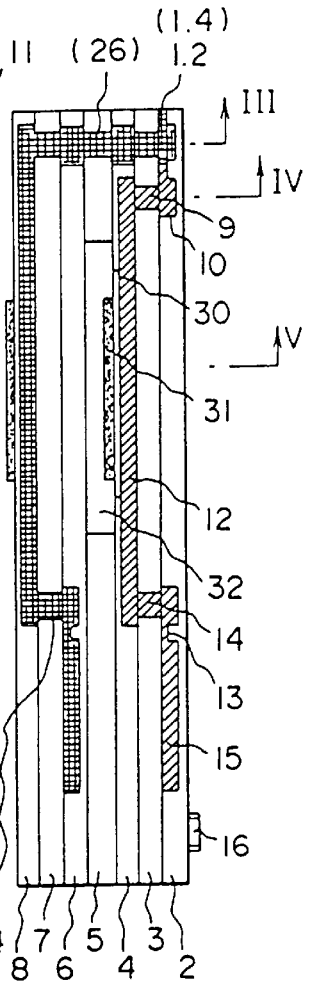
FIG. 6*c* is a sectional view taken along line II—II of FIG. 6*a;*

FIGS. 6*a*–6*d* pertain to a second embodiment of the ESIJIL print head. FIG. 6*a* illustrates a detail of the print head in an X-ray view. FIG. 6*d* illustrates a front view of the print head in an X-ray view. Details along section lines III—III, IV—IV and V—V are shown overlapped in the view of FIG. 6*d*. From this, together with FIG. 6*a*, the position of the ink chamber groups 101, 102, 103 and 104 becomes clear. FIG. 6*b* shows an overlapping of sections along the lines I—I and VI—VI of FIGS. 6*a* and 6*d*. FIG. 6*c* shows an overlapping of sections taken along lines II—II and VII—VII of FIGS. 6*a* and 6*d*.

The in-line nozzle groups 1.1–1.4 (of k=4 ink chamber groups 101, 102, 103 and 104) are each located in the first member 2. The first member 2 itself has only the chamber 11 of the first ink chamber group 101 of the k=4 chamber groups formed therein. A second nozzle group 1.2 in the first member 2 communicates with a chamber 12 of the second chamber group 102 which is formed in the second chamber-carrying member 4. The second chamber 12 is offset relative to the chamber 11 of the first chamber group 101 in member 2, and is supplied with ink through an opening 14 in the center member 3.

In accordance with the invention, second openings 14 are formed in the center member 3 for supplying ink to the second nozzle group 1.2. Facing the opening 9 in the center member 3 is an opening 10 in the first member 2 and a conduit in the second member 4 exiting each of the chambers 12 of the second chamber group 102, which communicate with the nozzle channels of the second nozzle group 1.2 formed in the first member 2.

The supply of ink to the ink chambers 11 and 12 in the first and second members 2 and 4, respectively, is effected through the common suction chamber 15 formed in the first member 2.

Ink is supplied to the suction chamber 15 via openings 16 and 17 in the first member 2, which forms a side part of the print head. The ink is further conducted through an opening 18 formed in the center member 3. Third and forth ink chamber groups 103 and 104 communicate with a further mutual suction chamber 25. The ink is supplied to the suction space 25 from an opening 18 in the center member 3, through an opening 19 in the second member 4, through opening 20 formed in a spacer member 5 or separation member 5, through an opening 21 in a third member 6 (third chamber-carrying member 6), and through an opening 22 in another center member 7. An opening 23 allows the ink from the chamber 25 to reach the nozzle 1.3 (aligned with the nozzle 1.1 in FIG. 6*b*) and an opening 26 allows the ink from the chamber 25 to reach the nozzle 1.4 (aligned with the nozzle 1.2 in FIG. 6*c*).

A piezo-electrical element 31, which is indicated in FIGS. 6*b*–6*d*, is well known in the art as a device to eject ink from a chamber. The element 31 may be disposed on the chamber surface or inside the chamber for placing the required pressure on the liquid ink contained within the chamber. When the piezo-electric member is excited, it applies pressure on the ink chambers through the resilient chamber walls, which results in the ejection of an ink jet from the nozzle communicating with the respective chamber. In the embodiment shown in FIGS. 6*b*–6*d*, the piezo-electrical element 31 is disposed on a surface of each ink chamber. In this case, for example, the ink chamber 12 is separated from the element 31 by a thin layer 30 made of the same material as the second member 4. It is elastic to such an extent that the bending energy (deformation energy) of the element 31 is only negligibly absorbed. Cavities or recesses 32 are formed in the spacer member 5 for receiving the elements 31, such that the latter abut on walls of the adjoining members in the vicinity of ink chambers.

In another advantageous embodiment of the invention, elongated openings may be used in the chamber-carrying members which are connected to respective elongated openings rotated by 90° formed in the center members and the spacer members comprising the print head structure. An ink jet print head configuration of such individual modules will not exhibit tolerance problems or problems associated with machining tolerances accuracy when it is assembled.

Again with reference to FIGS. 6*a*–6*c*, the shape of the openings 10, namely rectangular, make it rather unnecessary to accurately align the various members, as it has been necessary heretofore in the assembly of prior art edge-shooter ink jet print heads. In alternative embodiments, the openings may be shaped as ovals or as tapered holes, where the smallest diameter determines an amount of discharge. Furthermore, the openings 9 and 10 may also be disposed in two rows which run along the lines III—III and IV—IV.

As seen, the print head module may be structurally built from several sub-modules, in the embodiment of FIG. 6 from two sub-modules. A first such sub-module includes the first member 2 which carries the nozzle row, the third member 4 and the center member 3 sandwiched therebetween. A second sub-module is built from the two chamber-carrying members 6 and 8 and a center member 7 sandwiched therebetween. The chamber carrying members 2, 4, 6 and 8 have the chambers 101, 102, 103, 104, respectively, formed therein. Each sub-module has a suction chamber 15 and 25, respectively, and between the sub-modules there is at least one spacer member 5 which has an ink supply opening 20 and ink lead-through openings 23, 26 assigned to the chambers of the second sub-module. The spacer member 5 further has the recess or cavity 32 for receiving the ejection means 31 for ejecting ink from a chamber. Openings 22, 24 and the third openings of the center member 7 communicate with the ink chambers of chamber carrying members 6 and 8 to guide the ink from the respective chambers to the nozzles. Suction chambers 15, 25 of each module are connected to the chambers of the chamber groups 101, 102, 103 and 104 (with k=4) via second openings 14, 24 to supply ink thereto and each module has first openings 18, 22 to provide the ink supply to the suction chambers.

The manufacturing process is based on the presumption that a module is assembled from three members, equipped with piezo-electrical elements and bonded. A second module is attached to the first module via a spacer part 5, and together they form an ESIJIL print head. As mentioned, the second module with the members 6, 7 and 8 is not provided with nozzles, but only respective openings that are connected to the appropriate openings in the members 2, 3 and 4 of the first module.

Figure 7A:
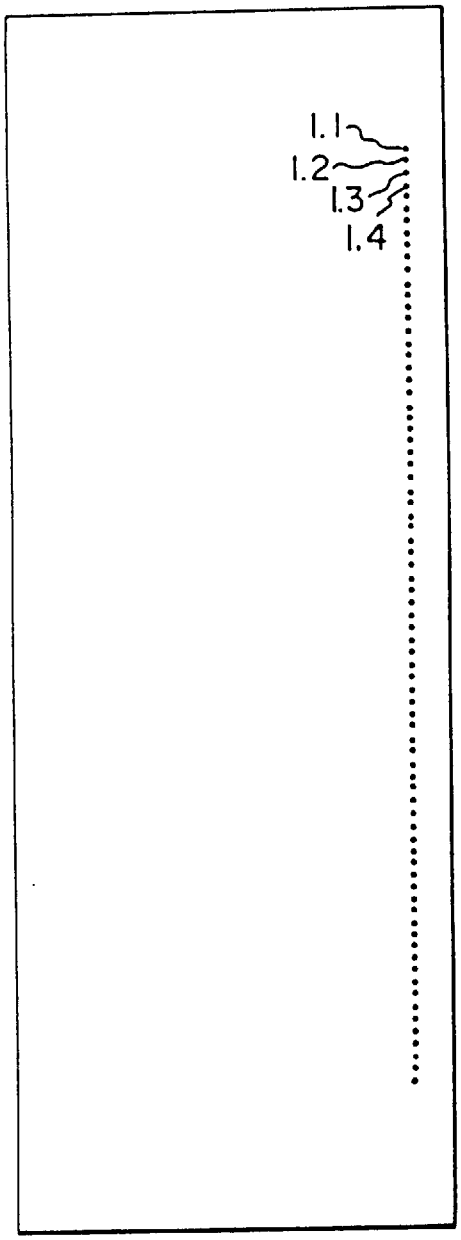
FIG. 7*a* is a front-elevational view of a third embodiment of the ESIJIL print head according to the invention.
Figure 7B:
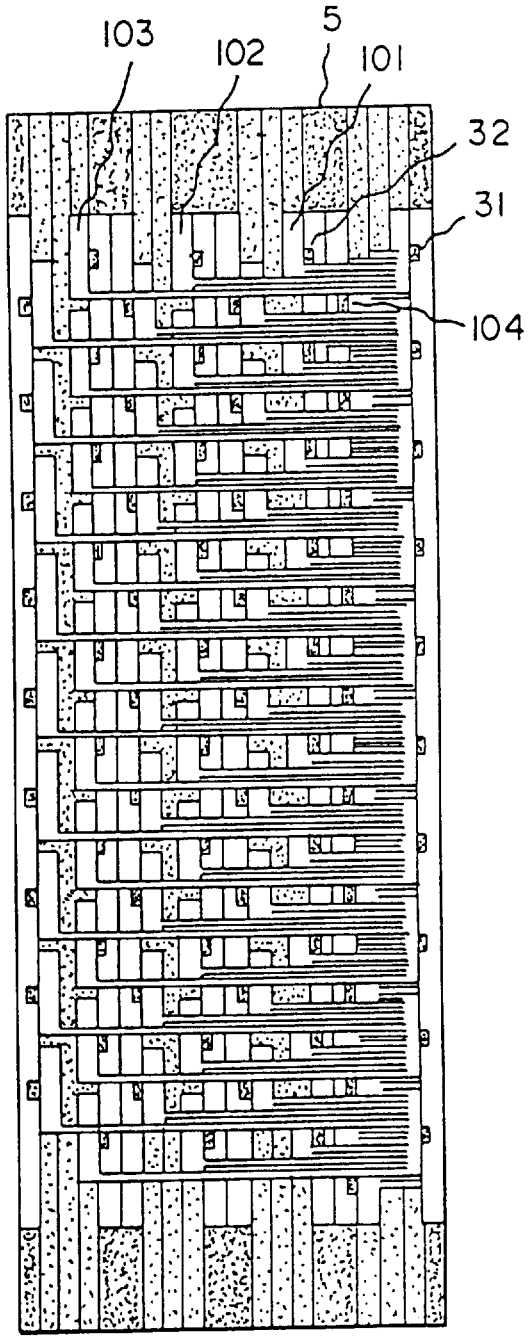
FIG. 7*b* is a sectional X-ray view of the ESIJIL print head of FIG. 7*a;*

Referring now to FIGS. 7*a* and 7*b*, a third embodiment of the ESIJIL print head is configured as a single module with several members. FIG. 7*a* shows is a front view of the print head with an in-line nozzle row and FIG. 7*b* is an X-ray seen from the same angle, with an overlapping of sections taken along lines which correspond to the lines III—III and V—V in FIG. 6. Every third opening lies on the line III—III. Further openings along the line IV—IV are not included. It is quite clearly seen from FIG. 7 that the nozzle density is determined by the dimensions of the nozzles only, i.e. as all of the conduits and chambers may be three-dimensionally displaced in an arbitrary manner, a lack of available volume does not significantly impair a packing density thereof. The nozzles fit in a single row, i.e. they are arranged in a two-dimensional manner. If larger chamber sizes are required, the body of the print head may be increased. Of course, it is also possible if required for higher machining tolerance demands to utilize elongated openings, as illustrated in FIG. 6 on the line III—III.

Unlike the spacer members in FIG. 6, the spacer members in FIG. 7 consist of two parts which are composed of the same material as the piezo-electrical elements (marked in black). These elements are made from the piezo-electric material, which is disposed on the chamber surface, but not on its edge. The cavities 32 are formed only in the direct vicinity of the elements 31. In the edge, ink supply openings as well as second and third openings are cut out. After the piezo-electrical elements are formed, these are bonded, and conductor paths are run on the chamber floors and/or on the outside along the layer 30.

Figure 8A:
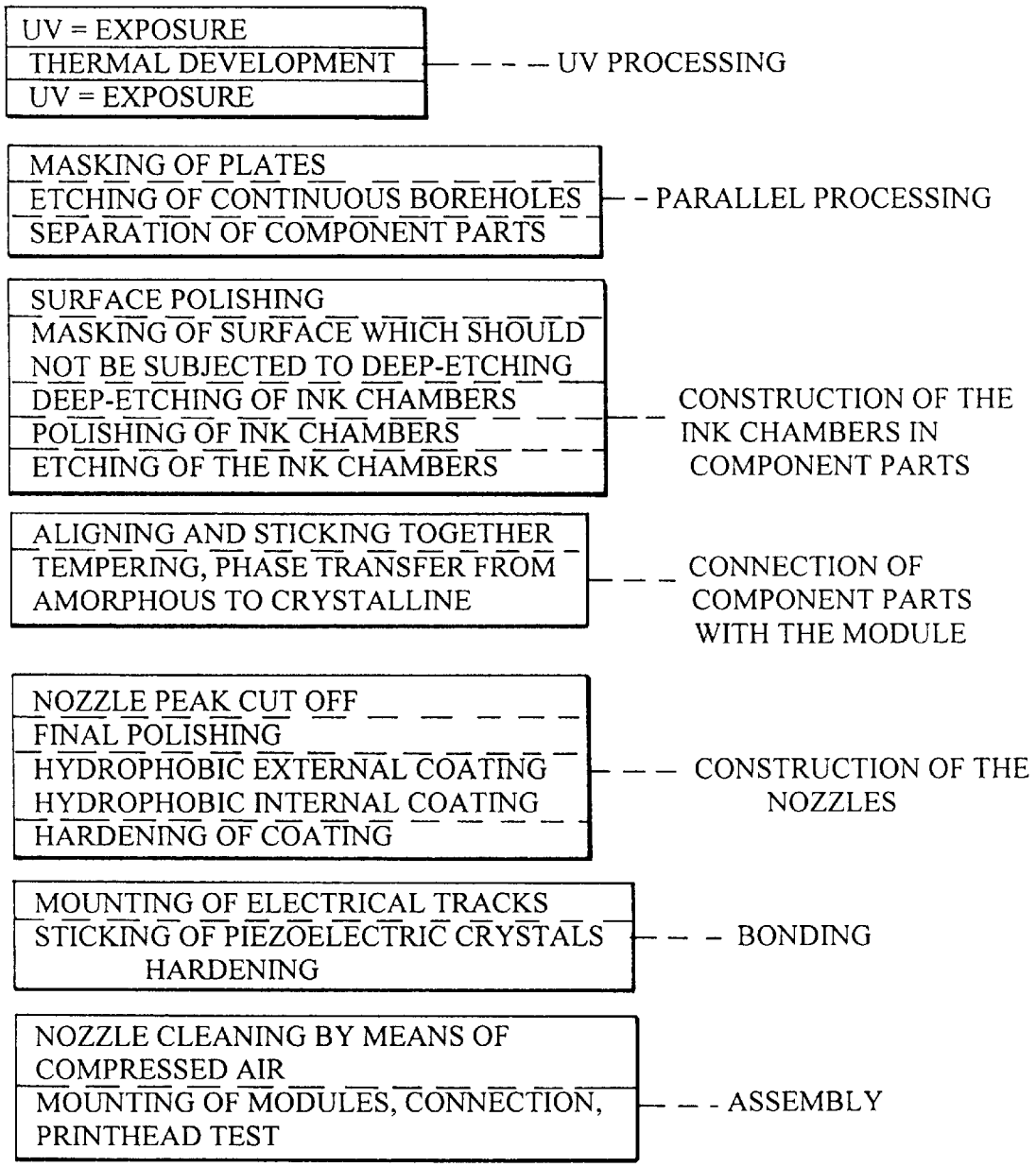

In FIG. 8, individual steps of a manufacturing process for preparing the ESIJIL print head according to the invention are shown.

By utilizing masks having the structure of the various parts that are to be manufactured, a photo-sensitive plate or pane of amorphous glass is masked and exposed to UV irradiation. The irradiated areas may then be etched some 100 times faster than non-irradiated areas. Following a heat treatment, there is a further exposure to UV radiation.

The parallel processing steps for several parts of a module include masking and subsequent etching of the continuous openings (ie. through holes).

Next the components are separated, with the completed center members being sorted out.

Before producing the ink chambers, the old mask layer is removed by a precision smoothing of the surface of the chamber parts. Next, the surface is masked in those areas that are not to be depth-etched. After etching the ink chambers, there is another precision smoothing of the components to arrive at final measurements and a further masking for producing the ink supply channels and nozzle channels, which should have a lesser depth than the chambers. Material removal is again effected by etching. In special circumstances, those areas irradiated with UV having more sensitivity are only etched, without the need for a mask.

It is preferred that, for the opening, chamber and channel areas, etchants of different concentrations be used making it possible to remove these respective areas with different accuracies with regard to their depths. The depth accuracy for continuous openings is less than that for very flat areas such as channels in the chamber-carrying members. Etching begins with the continuous openings, then the chambers, and followed by the nozzle channels. It is further preferred, that the thickness of the bottom layer 30 be kept under observation while etching the chambers and that the thickness of the bottom layer 30 of the chambers, which is essential in the formation of the chamber, be obtained by a precision smoothing of each of the chamber-carrying parts.

The components are then aligned and combined into a module. After the components are connected, the module is annealed during which there is a phase transition in the glass material from amorphous to crystalline.

The nozzle tips are cut by means of a rotary disc cutter to obtain a straight edge face. A smooth surface is obtained with a final precision smoothing.

By flushing with a first, suitable liquid common in the trade, a hydrophilic inner coating is created. Then by treating the edge face with a second, suitable liquid, a hydrophobic outer coating is obtained. After hardening the upper layer, the nozzles are completed.

Application of electric conductor paths onto the chamber surface, application of the piezo crystals, and bonding is effected in a conventional manner. The piezo crystals may be individually affixed, with a subsequent hardening. Alternatively, a layer of piezo-electrical material may be applied, which is then structured and bonded, onto the chamber surface. Application of the layer may be done by a sputtering process, for instance.

As a final step, compressed air is used to cleanse the nozzles.

In another method for the manufacturing process, the production of the chambers and the continuous openings in the components may occur in a single step. For that purpose, it is necessary to repeat the UV irradiation through different masks, before the glass plate is etched. Another possibility is to vary the intensity of UV irradiation. Accordingly, the glass plate has a varying sensitivity in different areas when it is etched. The dividing line between the various parts is also etched, which simplifies a later separation. The mask to be used in the process has open areas for both the chambers and the continuous openings. After etching, a precision smoothing to final specifications is effected, to obtain a desired thickness for the layer 30 on the chamber floor. The production of the ink nozzles and of the piezo-electrical elements as well as the production of the edges, is effected in the conventional manner as mentioned above. In this embodiment, the chamber floor is used for bonding. Then, the plate is separated and divided up into components that are then arranged as a module.

In yet another variant of the method, the back of the chamber surface may also or only be equipped and bonded with piezo-electrical elements. With bonding before separating, it is advantageous that the center members also may be equipped with conductor paths. Thus, a conductor leading from the other layers to the upper layer of the module may be obtained without crossovers, even if a large number of components are to be bonded. The module components are aligned, fixed together and annealed which causes the phase transition from amorphous to crystalline. It is preferred, that spacer members lie between respective modules arranged in a multi-module print head, and that the spacer members are made of the same plate material or of a layer of piezo-electrical material applied to the surface of the plate, which is then structured by etching. A print head may consist of several modules or only a single module having conductor paths, which are bonded externally, leading to the outside. The print head is finally arranged in a casing, and may be tested for operability to detect defective models. In another embodiment, the plate material or one of its components may consist of a photo-sensitive ceramic. Glass parts and/or ceramics parts may also be fixed to each other by an adhesive connection.

Figure 9B:
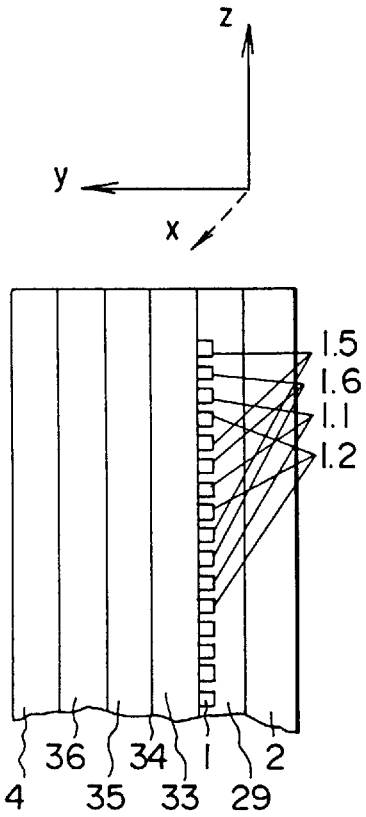
FIG. 9*b* is a side-elevantional view thereof on the nozzle side with a nozzle line of the ESIJIL print head.
Figure 9C:
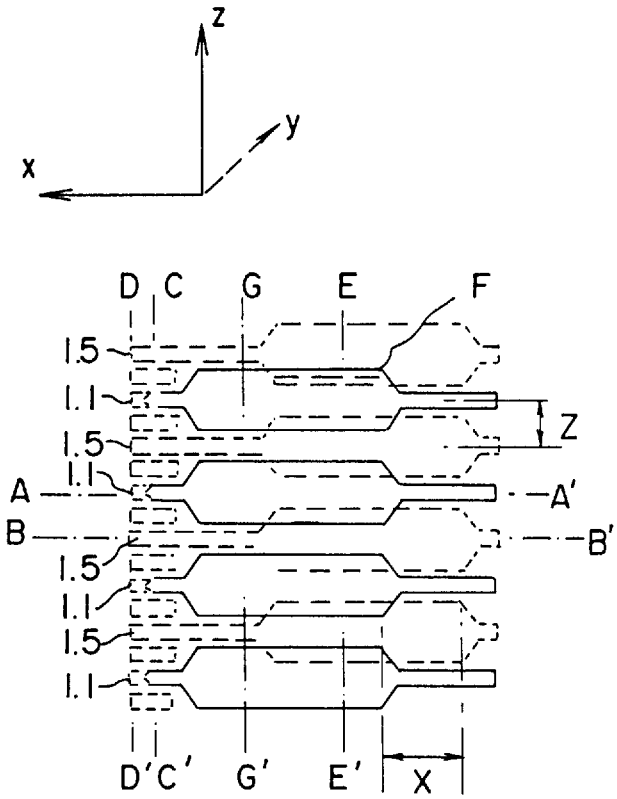
FIG. 9*c* is a plan view thereof onto the first chamber plate (component side), showing the position of the chambers in the first two planes.
Figure 9A:
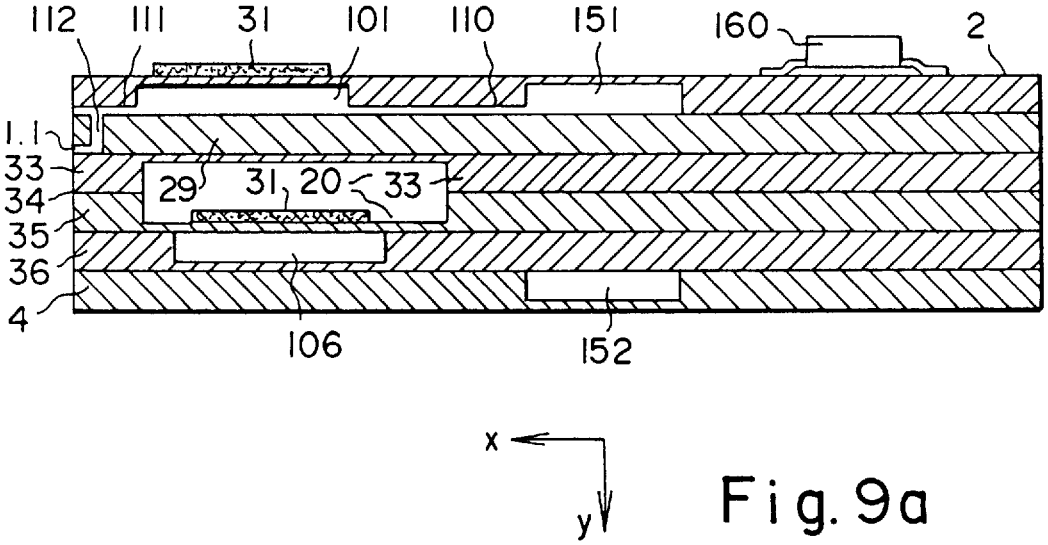
FIG. 9*a* is a cross-sectional of a first embodiment according to the instant CIP disclosure, taken along a line A–A' in FIG. 9*c;*

FIGS. 9*a*–9*c* pertain to a first embodiment of the ESIJIL print head which is the subject of this CIP disclosure.

FIG. 9*a* shows a cross-section through the edgeshooter ink-jet inline print head (ESIJIL print head) taken along the line A–A' (FIG. 9*c*). The print head shown essentially consists of two head modules, a first module formed by the plates 2, 29 and 33, and a second module formed by the plates 4,36 and 35. An ink chamber carrying part or chamber forming part 2 is disposed in a first plane. The openings, channels, a suction chamber 151, and chambers face towards a middle part 33 that consists of two layer-like separators. Beneath this, in the y-direction, there is disposed an additional chamber forming part 29 disposed in a second plane, and this has chamber openings in the same direction as in the first plane, the additional part 29 having the single nozzle row for all nozzles.

In the third plane, there is a first separator 33 which has comparable openings corresponding to the middle part, as in the embodiment of FIGS. 1–6. The second separator 35 is disposed in the fourth plane, with openings that are comparable to the middle part, and this is formed to the first separator 33 through an adhesive layer 34. Beneath the separators that form the middle part there are in each of the fifth and sixth plane a part 36, 4 that each form a chamber. The sixth part 4 that forms the chamber has openings, channels, a suction chamber 152 and the chambers of a chamber group 102. The open sides of the chambers and openings of the parts in the fifth and sixth planes face the middle part, discussed above, that is defined by the separators.

The ink passes through non-illustrated channels into a suction chamber 151 that is connected through channels 110 with the ink chambers of the first and second planes. The ink chambers are connected through channels 111 and ink transit openings 112 through the second plane with the nozzles, which are disposed in the second plane. Each ink chamber has an associated membrane and a PZT element that, when acted upon by an electrical pulse, deforms the membrane and thus changes the volume of the chamber. When the chamber volume expands ink is delivered from the suction chamber 151. On compression of the chamber volume of a chamber that belongs to chamber group 101 in the x direction, the ink droplets will be expelled through a nozzle that is part of nozzle group 1.1. This part, which is also shown in FIG. 10*a*, forms an upper half of the ESIJIL print head.

Figure 10A:
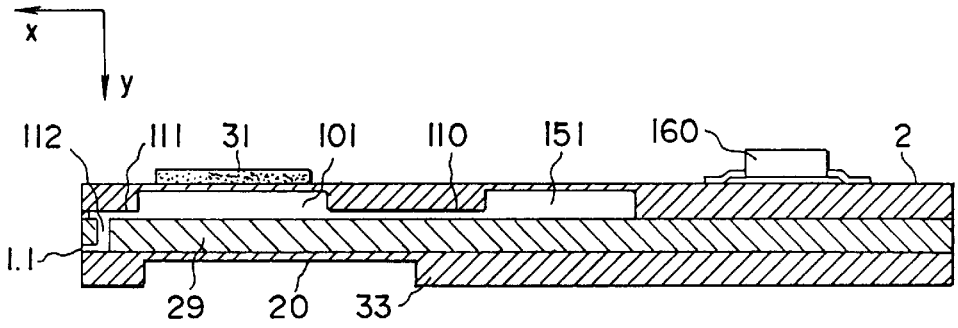
FIG. 10*a* is a cross-sectional view thereof taken along the line A–A' in FIG. 9*c* of the upper part with the first two planes.
Figure 10B:
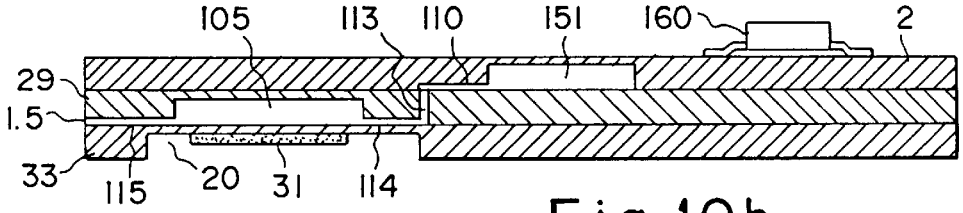
FIG. 10*b* is a cross-sectional view thereof taken along the line B–B' in FIG. 9*c;*

The feed conduits or feed channels between the suction chamber 151 in the first plane and the ink chambers in the second plane or the transit openings, respectively, the ink chambers in the second plane and the feed channels between the ink chambers in the second plane and the nozzles in the second plane, cannot be seen in the cross-section A–A' shown in FIG. 9*a* or 10*a*. For this reason they are shown in FIG. 10*b*, i.e. the cross-section B–B'.

In the same way, additional channels, openings, chambers, and the like (not shown in FIG. 9*a*) are disposed in the lower half of the ESIJIL print head in order to supply ink to the nozzles in the second plane of the upper half of the print head.

The nozzles that are associated with the nozzle groups 1.1, 1.5, 1.2, and 1.6 are disposed in one row in the z direction. In order to clarify this, FIG. 9*b* shows a section of an edge of the complete ESIJIL print head as in the first embodiment, with a corresponding nozzle arrangement in one nozzle row 1, in cross-section D–D'. It can be seen that the nozzle dimensions alone determine the maximum number of nozzles on the row. The nozzle diameter amounts to approximately one-quarter of the interval between two adjacent nozzles that are disposed on one nozzle line in a single nozzle row 1. Provision is made such that within the nozzle row, the nozzles of the nozzle group alternate with the nozzles of the other nozzle groups. In each instance, nozzles of nozzle group 1.1 and 1.5 and of 1.2 and 1.6 belong to an associated chamber of the chamber groups 101 and 105, or 102 and 106, respectively. The associated chamber groups 101, 105 of the upper half and the chamber groups 102, 106 of the lower half of the print head are arranged so as to be offset vertically in the y direction and, in addition, horizontally in the x and z directions.

FIG. 9*c* shows the position of the chambers in the first planes of the ESIJIL print head, in plan view as viewed from the component side according to the arrangement in the first embodiment. The chambers of the second chamber plate according to the present invention, which lie below, are indicated by dashed lines in order to indicate their position relative to the first chamber plate. The two chamber groups 101, 105 are offset by the distance X in the x direction and by the distance Z in the z direction.

The nozzle row 1 comprises nozzles that belong to the different nozzle groups 1.1, 1.2, 1.5, 1.6, that alternate in an advantageous manner such that the overlap of the chamber groups of the one plane with those of the other plane is only effective at the chamber edges. Also possible is another nozzle arrangement (not illustrated in FIGS. 9*a*–9*c*) in the nozzle line 1 according to another embodiment of the ESIJIL print head with a larger overlap area F. The overlap area F of one chamber of the chamber group 105 in the second chamber plate 29 with a chamber of the chamber group 101 in the first chamber plate 2 is shaded. The overlap area F of each chamber of the chamber group 101 (or 102) in the first (or fourth) chamber plate relative to the chambers of the chamber group 105 (or 106) in the second (or third) chamber plate can be minimized by the offset in the x and z direction.

The section in FIGS. 10*a*–10*e* show the layered structure of the print head and the path of the ink flow as in a preferred embodiment of the present invention (first embodiment as in FIGS. 9*a*–9*c*).

FIG. 10*a* shows the section A–A' with ink channel routing from a suction chamber 151 to an ink chamber 101 of the first plane and from there to the associated nozzle in the second plane 29. The first chamber plate 2 that forms ink chambers, lying in a first plane, is fitted with feed means 151, 110 and PZT elements 31 as actuators for expelling ink from one of the chambers associated with the nozzle belonging to the nozzle group 1.1.

The chamber plate 2 contains the structures of the ink chambers and horizontal ink channels 111 that run in the direction to the nozzles, as well as at least one suction chamber 151 and horizontal connecting channels 110 (suction inlet channels) from the suction chamber 151. In addition, it can also be seen that the chamber plate 29 incorporates vertical connection conduits 112 from the ink chambers of the first chamber plate 2 to their associated nozzles in the second chamber plate 29. The nozzle groups 1.1, 1.5 are connected to the associated chamber groups 101, 105 that are located in the chamber plate 2 or 29, respectively, through the ink channels.

FIG. 10*b* shows a corresponding cross-section B–B' with ink channel routing from the suction chamber 151, which shows the suction channel 110, 113, 114 to an ink chamber of the second plane that belongs to the ink chamber group 105 and from there through the nozzle channel 115 to the associated nozzle of the nozzle group 1.5. In the first embodiment, the upper print head half consists of three plates. In each chamber plate 2, 29 there is a group 101, 105 of ink chambers that is open on the side that faces the middle of the print head and which is covered by the part of the next plane that forms the chambers. Each separator includes machined-in areas 20 that are formed as a membrane on which PZT elements 31 are disposed as ink-expelling means.

Figure 10C:
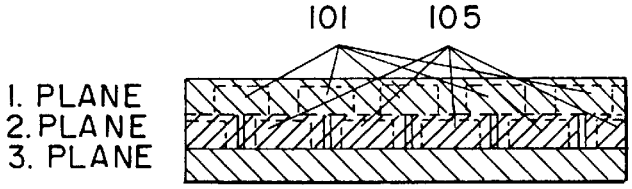
FIG. 10*c* is a cross-sectional view thereof taken along the line C–C' in FIG. 9*c;*

The section C–C' illustrated in FIG. 10*c* is located in the connecting planes in the x,y direction, at a short distance from the edge with the nozzle row. It makes clear how, according to the present invention, a particularly high density is achieved in the arrangement of the nozzles in each print-head half.

Figure 10D:
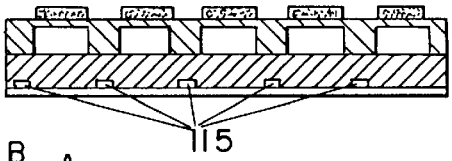
FIG. 10*d* is a cross-sectional view thereof taken along the line G–G' in FIG. 9c.

FIG. 10*d* shows a cross-section through the line G–G' of the plan view of FIG. 9*c* for the upper half, the section passing on the one hand through the chambers of the first plane and, on the other, through the horizontal nozzle channels 115.

Figure 10E:
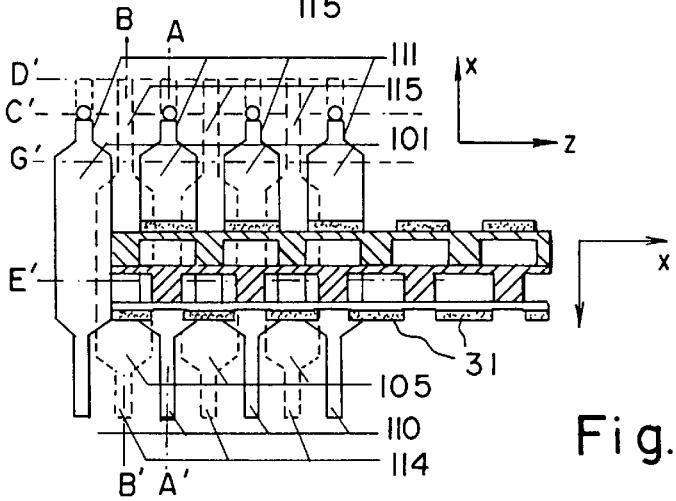
FIG. 10*e* is a cross-sectional view thereof taken along the line E–E' and in combined representation with the view 9*c;*

In FIG. 10*e*, a cross-section on the line E–E' has been imposed on the left-hand half of the plan view shown in FIG. 1*c*, the cross-section E–E' passing through all the chambers of the planes of the upper half of the print head.

Photo-sensitive glass is used as the material for all the plates of the print head. Structuring, including the formation of the nozzles, is effected by means of a photolithographic process and by etching out the parts that have been exposed.

The transit openings or conduits 112, 113 can be produced in various ways. They can be etched, burned out with a laser beam, or stamped out using special tools. The selection of the process will depend, amongst other things, on the material that is used.

The homogenous and tight connection between each three plates 2, 29, 33 or 4, 36, 35 is achieved by means of thermal diffusion bonding.

FIGS. 11–15 show other embodiments of the present invention (embodiments 3 to 7 of this continuation-in-part).

Figure 11:
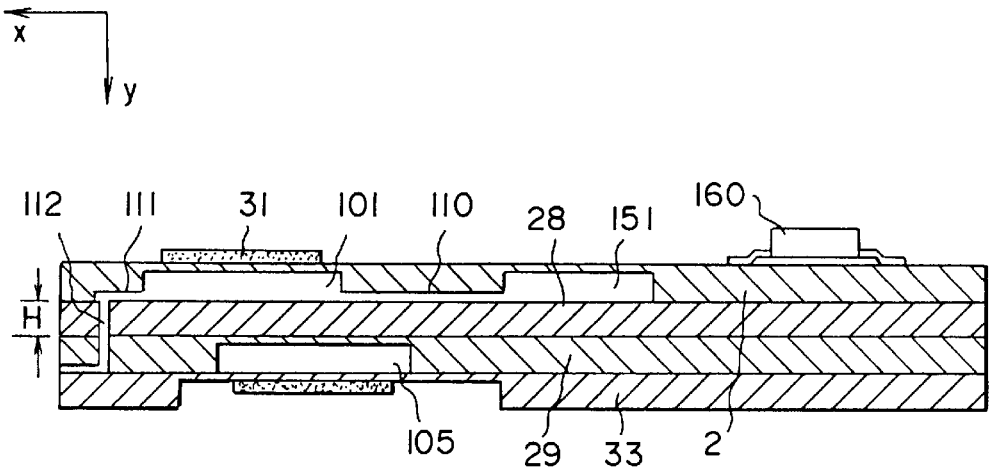
FIG. 11 is a cross-sectional view along the line A–A' of a part of the ESIJIL print head according to a third embodiment.

FIG. 11 is a cross-section along the line A–A' of a part of the ESIJIL print head according to a third embodiment. In order to reduce the overlap area between the chambers of different chamber groups, the interval between the chambers in the x-direction has been increased. According to the present invention, an additional separator 28 is disposed between the parts 2 and 29 that form the chambers. The offset in the x-direction can thus be increased by the value H. The corresponding section on the line B–B' and C–C', etc., for the corresponding parts of the ESIJIL print head do not have to be explained in detail, for they are similar to the cross-sections as in the first embodiment.

Figure 12:
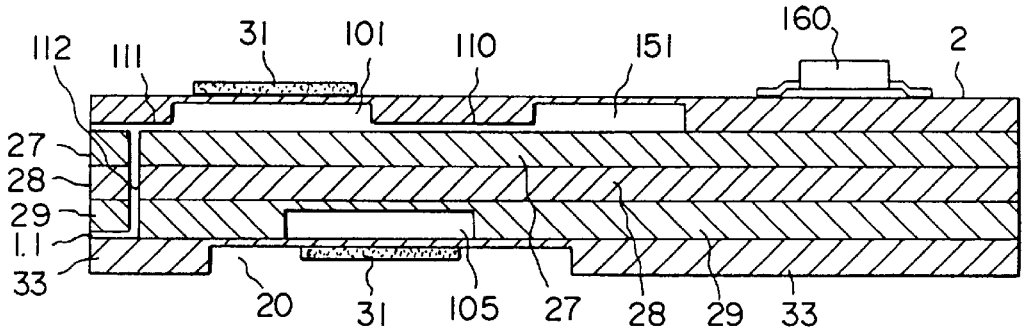
FIG. 12 is a cross-sectional view taken along the line A–A' of a part of the ESIJIL print head according to a fourth embodiment.

FIG. 12 shows a further variation of the present invention, namely a cross-section through the line A–A' of a part of the ESIJIL print head according to a fourth embodiment. By interposing two separators 27 and 28 between the parts 2 and 29 that form the chambers, the offset in the y-direction can be increased by the value 2*H relative to that in the first embodiment of FIG. 10*a*. This permits not only an additional reduction of the overlap of the chambers, rather, in a manner not shown herein, a second embodiment can be created by combining a lower half of the ESIJIL print head with the parts 35, 36, and 4, produced according to the first embodiment (FIG. 9*a*) with an upper half of the ESIJIL print head with the parts 27, 28, 29, and 33, as used according to the fourth embodiment (illustrated in FIG. 12). This second embodiment, with a common row of nozzles in the upper half of the ESIJIL print head and ink paths that are of equal length, can be used to advantage in print heads that are used to print at higher resolution.

Figure 13:
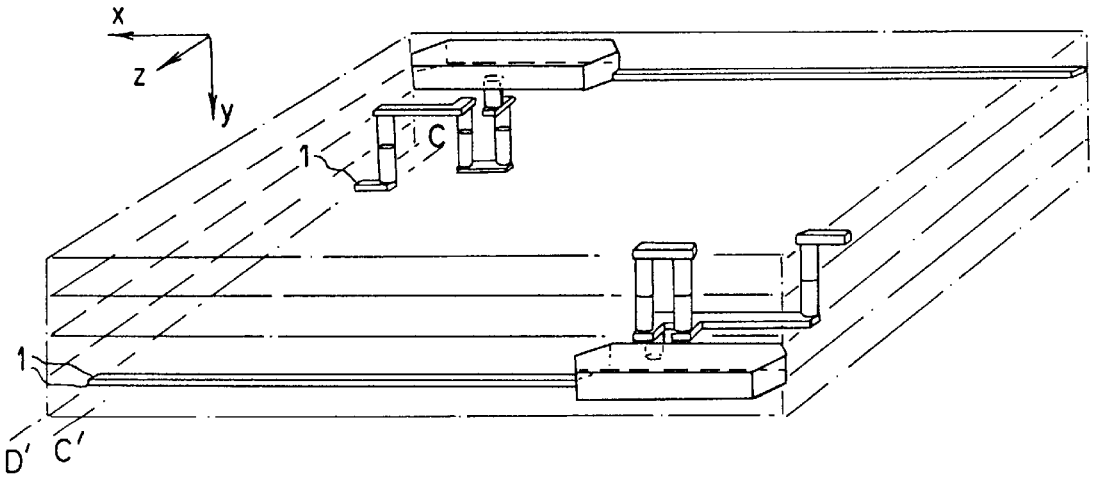
FIG. 13 is a perspective view of the ink feed of a portion of the ESIJIL print head according to a fifth embodiment.

FIG. 13 shows the ink routing in a perspective view for a detail of the ESIJIL print head. Each ink channel 111, 115, respectively, incorporates sections for routing the ink in other planes, and the ink chambers of a group are disposed closer to the nozzle edge by a path length. In contrast to this, the ink chambers of the other group are disposed closer to the non-illustrated suction chamber 151, 152. Each ink channel thus has sections of the ink routing in other planes.

Figure 14:
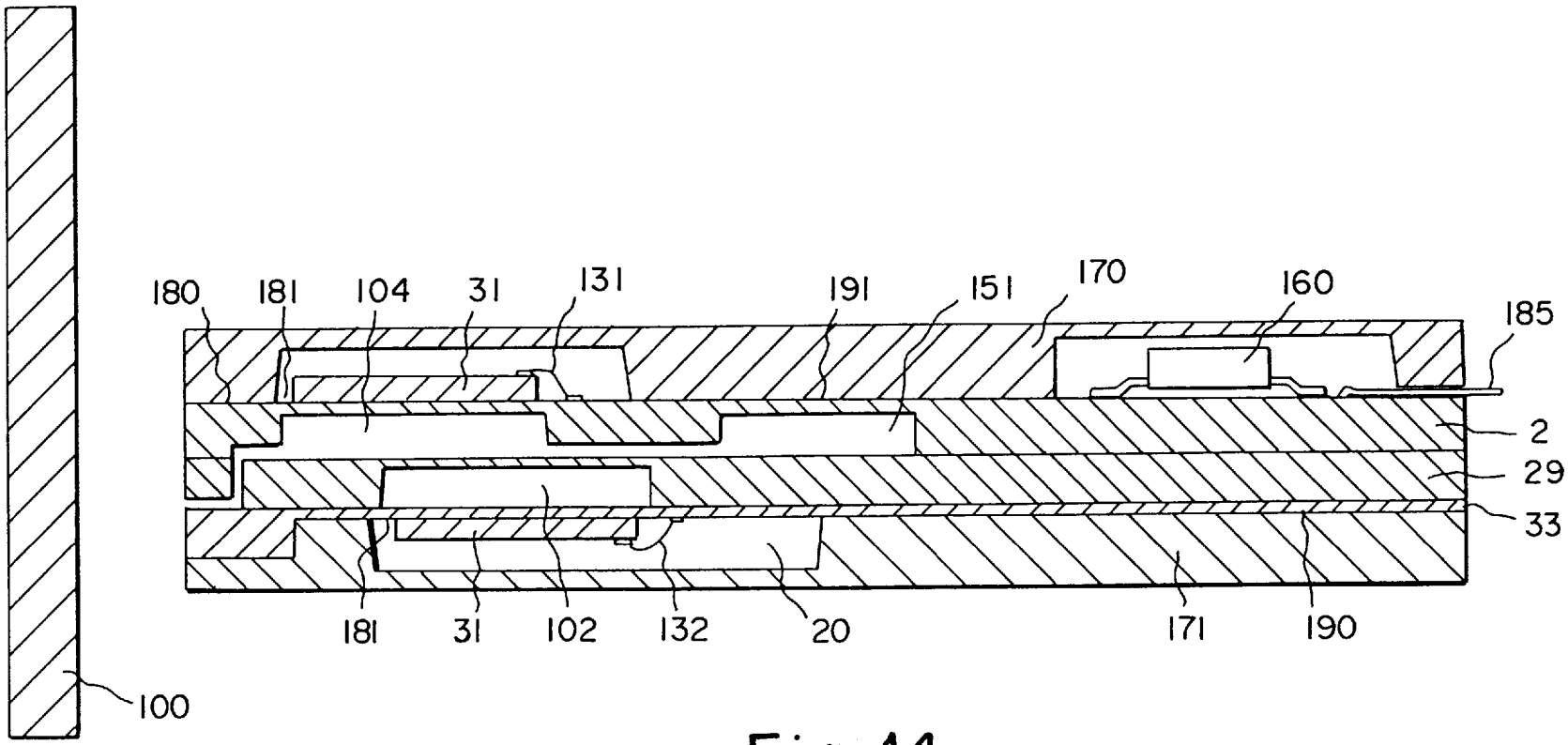
FIG. 14 is a cross-sectional view taken along the line A–A' of the ESIJIL print head according to a sixth embodiment.

FIG. 14 shows a part of the ESIJIL print head according to the present invention, according to the first embodiment, in section along the line A–A', the whole print head being used to print at lower resolution and consisting only of the parts 2, 29, and 33 of an upper half. The circuit configuration 160 (driver circuit) and the actuators 31 are protected against environmental effects by external molded plastic parts 170, 171. The PZT elements are connected to the conductor tracks 190, 191 through bonded wires 131, 132, and these conductor tracks 190, 191 lead to the driver circuit 160. A ribbon cable 185 provides a connection to the control electronics, for example, of a franking machine. A defined distance between the print head and the surface 100 of the mail is maintained by a spacer plate (not shown in greater detail herein).

The lines from the PZT elements of the second chamber plate are also on the circuit side. The conductor track routing on the circuit side of this module is described in one of our copending applications. The type HV 04 or HV 06, HVC-MOS technology, produced by Supertex Inc. can be used as the driver circuit. This includes a 64-bit series/parallel shift register with 64 subsequent latches that are connected through NAND and OR gates to 64 SEAMOS driver stages that can deliver an output of up to Vs=80V. The suction chambers 151, 152 are connected on the periphery of the module by means of a passage 150, a further passage 153 leading to a damping element 154 on the surface (circuit side) of the module, this being connected through at least one feed channel 155 to an ink supply orifice. The complete module (not shown in greater detail herein) has, in the known manner, bores 177 for securing the module and grounding tracks 180 with connected electrode surfaces 181. The particular PZT crystal is (subsequently) disposed on the latter and contacts established with it. The other electrode on the surface of the PZT crystal is connected to the associated conductor track 190 which leads to the appropriate output of the driver circuit by way of a bonded wire.

Figure 15:
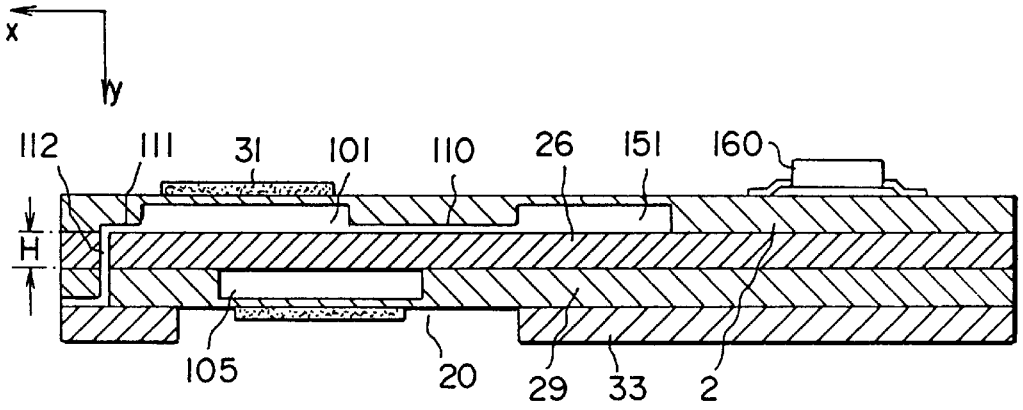
FIG. 15 is a cross-sectional view taken along the line A–A' of the ESIJIL print head according to a seventh embodiment.

FIG. 15 shows a seventh embodiment with equal ink path 20 lengths for an upper half of the ESIJIL print head, which incorporates parts 2 and 29 that form chambers and an additional spacer 26 between the parts 2 and 29 that form the chambers, with which the chamber openings are covered. In the seventh embodiment, for building up an ink-jet print head, the ink chambers of the second chamber plate are structurally disposed in front of the opposite side. This means that no additional spacer is required as a membrane plate that closes off the ink chambers from below. Instead, the middle plate 26 is used in order to seal the ink chambers tightly. By displacing the chamber group in the x, y, and z directions in each part that forms chambers relative to the chamber group in an additional part that forms chambers, it is possible to achieve an equal ink path length throughout.

My previously disclosed solution can be improved with a preferred embodiment in the way described in connection with the second embodiment. By combining the seventh embodiment with one of the previously described embodiments, which use middle plates as separators, and/or with measures according to the fifth embodiment, it is possible to obtain ink paths of equal length to each nozzle.

An edge-shooter ink-jet print head can comprise modules that are built up differently. In this context, provision is made such that the parts 29 or 36 that form chambers that are disposed additionally between the middle part 33, 35 and the first part 2 that forms chambers, or the middle part 33, 35 and an additional part 4 that forms chambers, are of the same or opposite orientation in the chamber configuration. For example, in one embodiment (FIG. 9) that uses opposite orientation of the chambers, the orientation relative to the middle part 33, 35 is then in the same direction. Both groups of chambers 105, 106 formed on the side of the additional part 29, 36 that forms the additional chambers and faces the one middle part 33, 35. On the other hand, in another embodiment (FIG. 16) for identical orientation in the chamber configuration, the orientation relative to the middle part 33, 35 is then in the opposite direction.

Figure 16:
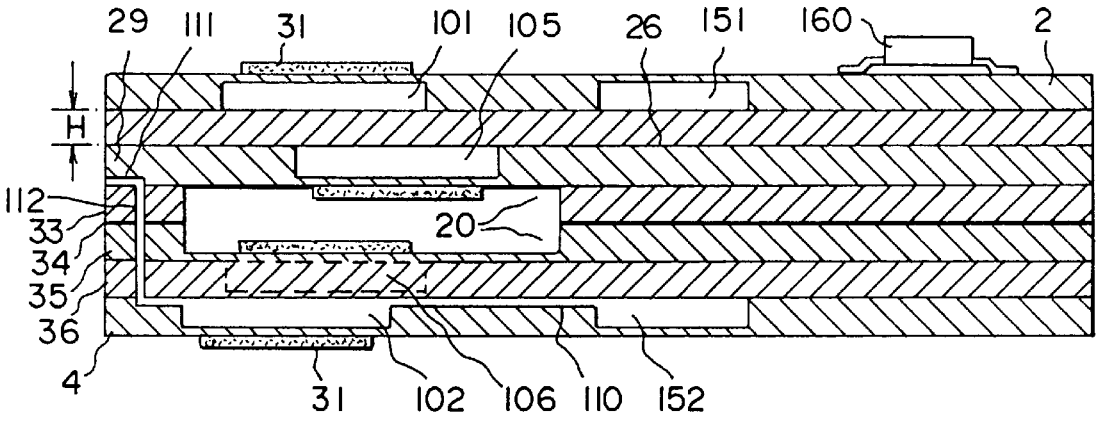
FIG. 16 is a cross-sectional view through an exemplary ESIJIL print head with a combination of various modules.

FIG. 16 shows a cross-section through an ESIJIL print head with a combination of different modules. In this embodiment, the three parts 29, 36, and 4 are provided for orientation in the same direction within the chamber orientation.

The reversed embodiment, which is not illustrated in the figures, has a group of chambers 105 on a part 29 that forms the chambers that faces a middle part 33, whereas a group of chambers 106 on the side of the other part 36 that forms the additional chambers is formed on the side that faces away from a middle part 35.

In another, non-illustrated, embodiment for orientation in the same direction, both groups of chambers 105, 106 are formed on the side of the part 29, 36 that forms the chambers that faces away from a middle part 33, 35. This embodiment results if an appropriate lower print head half is disposed with the print head half shown in FIG. 7.

For a combination of modules that are built up in the same way or differently in a print head, the middle parts consist of separators 33 and 35 that are joined to each other through an adhesive layer 34. In at least one additional plane between the parts 2 and 29 that form the chambers there is at least one additional spacer 27, 28 of thickness H which results, in the way described above, in an additional displacement of adjacent chamber-forming parts 2, 29 in the x and y directions. In this context, it is also advantageous that the offset in the x, y, and z directions is so formed that the ink path within adjacent modules is of almost equal length, with openings for the transit channels 112 being formed in the adhesive layer 34, these then leading through the middle part 35, 33 to the nozzles of the nozzle groups 1.2 and 1.6 in the additional chamber-forming part 29.

In addition, by extending the ink chambers into a plurality of planes, the width of the ink chambers can be optimized so as to correspond to a lower triggering energy, and the nozzle density in the nozzle line 1 can be increased. Only if there is a requirement for even greater resolution would an additional print module have to be incorporated, as is described in the German patent document 43 09 255, which describes a further solution for a modular ink-jet print head.

An additional increase in printing density can also be achieved by the usual inclined position of the module to the direction of print.

A preferred mode of a method for manufacturing ink-jet print heads incorporates the following steps (described in further detail above with reference to FIG. 8):

parallel processing of a glass plate for the production of variously structured module plates, fine grinding, and the deposition of conductor tracks;

separation and joining of the individual parts to form at least one module, with subsequent tempering;

the deposition, processing, and installation of contacts between the piezo-electric elements and the conductor tracks that have been applied;

assembling to form a print head.

Figure 17:
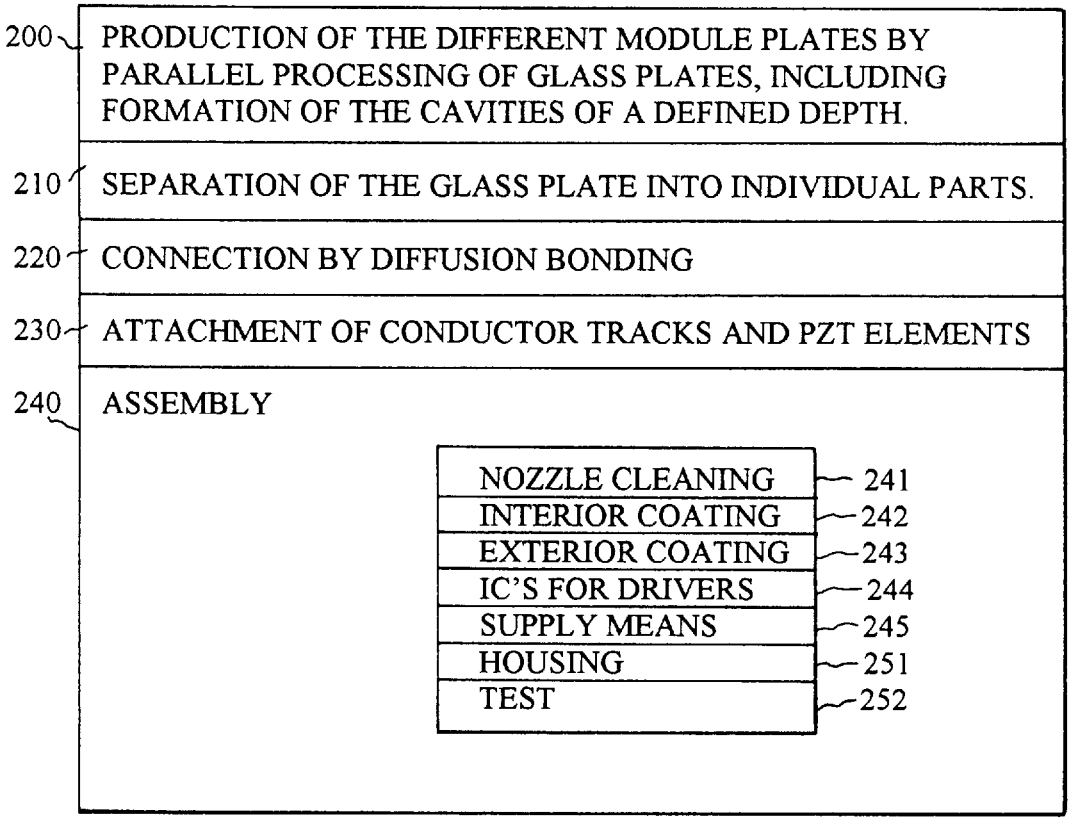
FIG. 17 is a manufacturing flow chart for the ESIJIL print head according to the embodiment of FIG. 14.

The development of the above manufacturing process is shown in FIG. 17 with reference to the ESIJIL print head according to the present invention of FIG. 14.

According to the present invention, in a first Step 200 the chamber parts for the lower planes are produced simultaneously for those of the upper planes, and simultaneously with the separators or the nozzle plate, respectively, from a common glass plate. When this is done, processing steps involving etching and fine grinding are used, as has been proposed with respect to manufacturing an ESIJIL print head as set out in the parent application. The thickness H of each plate is approximately equal and is adjusted precisely by fine grinding. The required offset between the chamber groups in one plane is ensured at the highest degree of accuracy by the lithographic process that preceeds etching.

The production process for the ESIJIL print head according to the present invention is based on using a wafer of photo-sensitive glass, onto which a mask is laid. After irradiation with ultraviolet light, a phase conversion of the amorphous material into its crystalline phase is brought about by thermal treatment of the areas that have been irradiated. Then, crystalline material is removed layer by layer by etching, as has already been proposed by IBM in U.S. Pat. No. 4,092,166.

Etching agents at different concentrations and/or having different etching times are used for the three areas, in order that the appropriate areas can be removed to varying degrees of precision with respect to depth, the depth accuracy being less when etching areas for continuous bores than it is when etching very flat areas for the channels in the chamber parts, when first the continuous bores, then the chambers, and then the nozzle channels are etched. Provision is also made such that the thickness of the base layer is monitored when etching the chambers, and such that the thickness of the base layer (membrane) of the chambers that is required to conclude the production of the chambers is achieved by fine grinding each of the chamber parts.

Then, in Step 210, separation into individual chamber plates or spacers is carried out.

In Step 220, the individual parts are combined to form a module. When this is done, the individual parts are first aligned and the module that results from cementing the individual parts to each other is next tempered. During tempering, there is a phase transition from amorphous to crystalline within the glass material.

Then, in Step 230, the electrical conductor tracks are installed on the surface of the separators, including the membrane or on the chamber surface, respectively; the piezo crystals are installed and contacts are established in the usual way. The piezo crystals can be cemented into position individually and then the adhesives can be hardened subsequently. On the other hand, a layer of piezo electric material can be applied to the surface that has the conductor tracks and this is subsequently structured and contacts provided. Provision is made such that the PZT layer is first separated into individual PZT elements, preferably by using laser processing. After depositing additional conductor tracks, the contacts are established for the PZT elements.

Finally, it is also possible to metallize a pretreated PZT plate and apply it to the first chamber plate or separator, respectively. Installation can be effected in an advantageous manner by adhesion. Next, a number of individual PZT elements are separated for each module. The PZT elements have contacts installed on them, if necessary, after the application of additional conductor tracks.

The installation of the PZT elements can be effected in the following manner:

A first pre-treated PZT plate is metallized and applied to the chamber plate. Next, a number of individual PZT elements are separated for that side of the module.

A second pre-treated PZT plate is metallized and installed on the membrane of the separator. Then, a number of individual PZT elements are separated for that side of the module.

The assembly in Step 240 to produce a configuration for a print head as in FIG. 14 can be effected in an advantageous way during the production process, as follows:

Nozzle cleaning by means of compressed air, in Step 241;

Processing (cleaning and flushing) of the chambers and nozzles, in Step 242. A water-resistant inner coating is formed by flushing with an initial and suitable commercially available liquid;

A water-resistant outer coat nozzle platained by treating the nozzle plate on the printing side, in Step 243, with a second suitable liquid. The nozzles are finished after the upper layer has hardened;

Providing the module with the necessary driver circuits on the side of the module that is orthogonal to the printing side and optionally with a protective housing, in Step 244;

In Step 245, the module is combined with the other additional means required for the operation thereof (electrical, mechanical, and ink supply means);

Then, in Step 251, the print head is installed in its own housing before it is tested for correct operation, in order to eliminate any faulty units;

Finally, the finished print head is tested in Step 252.

Figure 18:
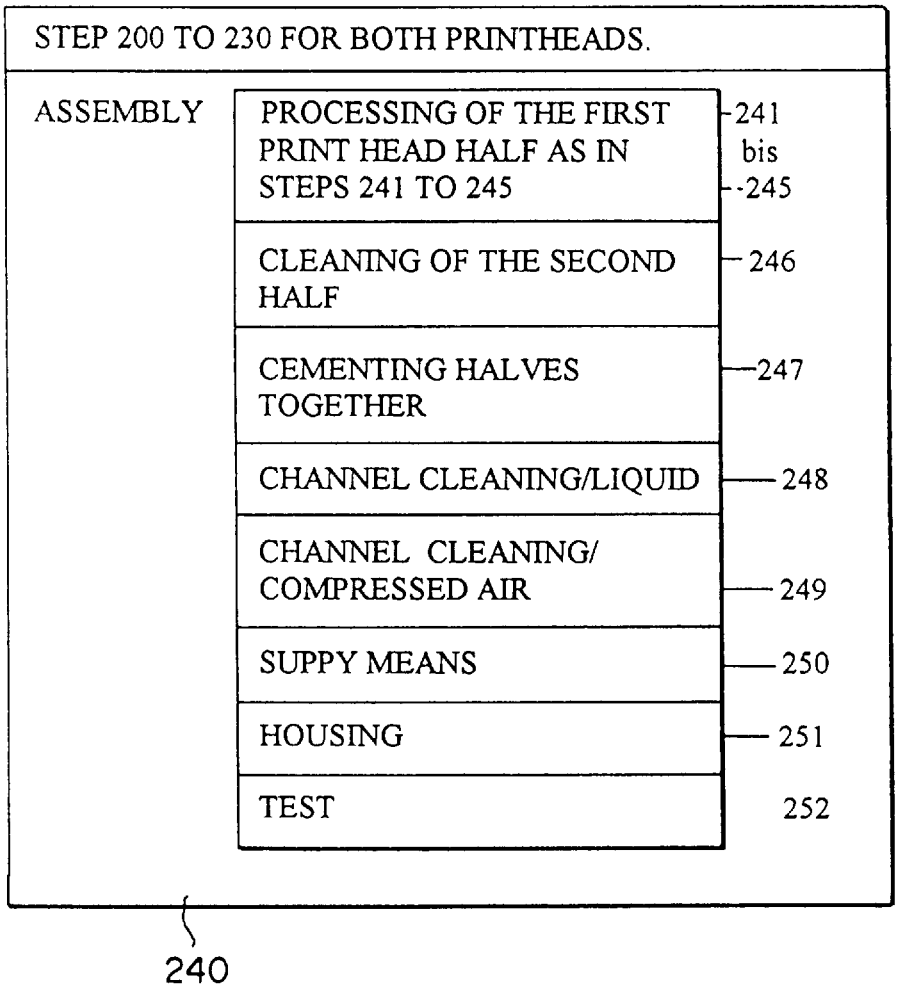
FIG. 18 is a manufacturing flow chart for the ESIJIL print head according to FIGS. 9 and 16.

FIG. 18 shows a production procedure for the ESIJIL 20 print head according to the present invention, as in FIG. 9 or FIG. 16. Initially, the Steps 200 to 230 described above are carried out, this time for both halves of the print head.

Assembly to form a configuration as shown in FIGS. 9 and 16, and the configuration of FIG. 12 in combination, or a configuration as in FIG. 15 in combination with other arrangements to form a multi-level print head requires a modification to Step 240 of the production process. For the first print head half, assembly can be effected in the above-described manner by means of Steps 241 to 245;

Nozzle cleaning by means of compressed air in Step 241;

Processing (cleaning and flushing) of the chambers and nozzles to produce a water-resistant inner coating in Step 242;

Processing of the nozzle edge on the printing side with a second suitable fluid in order to produce a water-resistant outer coating and to harden the upper layer on the nozzle edge, in Step 243;

Providing each module with the necessary driver circuits on the side of the module that is orthogonal to the printing side and with a protective housing, in Step 244;

Combining the module with other different means (electrical, mechanical, and ink supply means) that are required for its operation. This is followed by a test of one-half of the print head for the nozzles of nozzle groups 1.1 and 1.5 or chamber groups 101 and 105 in Step 245.

According to the present invention, this is followed by assembly Steps 246 to 250 for the second print head half;

Preparation of the second print head half by cleaning, flushing by means of a cleaning agent, and with compressed air, in Step 246;

Cementing the print head halves together in Step 247, using an adhesive layer 34. In one advantageous version, the adhesive layer 34 has an adhesive that can be dissolved by means of a solvent, as long as it has not hardened. This adhesive layer 34 can be applied, for example, as a self-adhesive foil on one half of the print head. Next, material is removed from the foil, for example, by means of a laser beam, in order to open up transit openings to the channels 112, that lead through the separators 33 and 35 to the nozzles of nozzle groups 102 and 106. The other half of the print head can be provided with an adhesive layer in the manner described above, and treated similarly. After the two print head halves are positioned one above the other, and after they have been joined, the adhesive layer 34 is hardened in that energy is applied. Provision is also made such that the supply of energy be so controlled with respect to time and position in a special manner that the channels 112 that lead to the nozzles are not plugged by the adhesive of the adhesive layer, or such that blocked locations do not harden so rapidly, so that any possible blockage can still be eliminated;

Cleaning the channels in Step 248 by means of an appropriate solvent for the adhesive (it should be noted that the ink solvent agent is not one of these solvents);

Cleaning the channels in Step 249 by means of a cleaning agent and with compressed air;

Combination of the module with other different means (electrical, mechanical, and ink supply means) that are required for its operation, in Step 250;

Then, once again, the print head is installed in a housing, in Step 251 before it is tested for correct operation in Step 252, in order to eliminate any faulty units.

I claim:

1. An edge-shooter ink-jet printhead, comprising a head module defining mutually orthogonal directions including an x-direction, a y-direction, and a z-direction and having nozzles formed in an end face thereof for expelling ink in the x-direction, said head module being formed of a plurality of plates stacked one upon another in the y-direction, said plates including a first ink chamber-carrying part having ink chambers formed therein for receiving ink;

a middle part disposed on said first ink chamber-carrying part;

a second ink chamber-carrying part having ink chambers formed therein for receiving ink and being disposed on said middle part;

a further ink chamber-carrying part having ink chambers formed therein for receiving ink and being disposed between said first ink chamber-carrying part and said middle part;

said nozzles communicating with said ink chambers in said first ink chamber-carrying part, said second ink chamber-carrying part, and said further ink chamber-carrying part through conduits and said nozzles being mutually aligned on said end face in a nozzle row extending in the z-direction;

said nozzle row being formed in said further ink chamber-carrying part;

said ink chambers formed in said first ink chamber-carrying part and in said second ink chamber-carrying part forming groups of ink chambers; said groups of ink chambers being offset relative to one another in the x-direction, the y-direction, and the z-direction for forming ink paths from said suction chambers to respectively associated ones of said nozzles having a substantially uniform length within each of said modules; and means for supplying ink through said chambers and for expelling ink from said nozzles.

2. An edge-shooter ink-jet print head according to claim 1, wherein said nozzles in said nozzle row belong to given nozzle groups, said nozzles of different nozzle groups alternating with one another such that said ink chambers of one plate overlap said ink chambers of another plate in the y-direction only at chamber edges thereof.

3. An edge-shooter ink-jet print head according to claim 1, wherein said first ink chamber-carrying part, said further ink chamber-carrying part, said middle part, and said second ink chamber-carrying part define a plurality of planes of said module, and wherein said ink chambers are disposed relative to said nozzle row and relative to said suction chambers for forming ink channels of varying lengths in each of said planes of said module, said conduits being formed of nozzle channels, inlet channels and transit channels in said second ink chamber carrying parts, a sum of the varying lengths of ink channel for each of said ink chambers remaining substantially constant.

4. An edge-shooter ink-jet print head according to claim 1, including another head module, said middle parts of each of said head modules being disposed on one another, said ink chamber carrying parts each defining a given ink chamber formation, said ink chamber formation in said second ink chamber carrying part being oriented opposite said ink chamber orientation in said first ink chamber carrying part.

5. An edge-shooter ink-jet print head according to claim 1, including another head module, said middle parts of each of said head modules being disposed on one another, said ink chamber carrying parts each defining a given ink chamber formation, said ink chamber formation in said second ink chamber carrying part being oriented in the same direction as said ink chamber orientation in said first ink chamber carrying part.

6. An edge-shooter ink-jet print head according to claim 1, including another head module, said middle parts of each of said head modules being spacers and being joined to one another with an adhesive layer; and at least one additional separator plate having a given thickness disposed between said first and second ink chamber carrying parts, said additional separator plate defining an offset in the x and y-directions between adjacent ones of said first and second ink chamber carrying parts.

7. An edge-shooter ink-jet print head according to claim 6, wherein said offset in the x, y, and z-directions is so formed that an ink path length within adjacent head modules is substantially equal, said adhesive layer having openings formed therein defining transit channels through said middle part and to said nozzles of nozzle groups in said second ink chamber carrying part.

8. An edge-shooter ink-jet print head according to claim 1, wherein said ink chambers in said first ink chamber-carrying part and said second ink chamber-carrying part overlap one another and define an area of overlap, and including additional ink conduits formed in said head module for minimizing said area of overlap.

9. An ink jet print head of the edge-shooter type, comprising:

a first chamber-carrying member having a plurality of ink chambers for receiving ink formed in a flat surface thereof;

a second chamber-carrying member having a plurality of ink chambers for receiving ink formed in a flat surface thereof;

said first chamber-carrying member having nozzles formed therein each assigned to a respective one of said ink chambers; means for ejecting ink from said ink chambers through said nozzles;

said nozzles formed in said first chamber-carrying member forming a single nozzle row having k nozzle groups and extending in a first direction, said ink chambers having $k \geqq 2$ chamber groups with each of said nozzle groups associated with a respective one of said chamber groups;

said ink chambers formed in said first chamber-carrying member being a first chamber group and said ink chambers formed in said second chamber-carrying member being a $k^{th}$ chamber group, a first nozzle group of said k nozzle groups communicating with said first chamber group, and a $k^{th}$ nozzle group of said k nozzle groups communicating with said $k^{th}$ chamber group; and said nozzle openings extending and ejecting ink droplets in a second direction substantially orthogonal to said first direction, said k chamber groups being disposed in a third direction relative to one another, said third direction being substantially orthogonal to said first direction and to said second direction.

10. The ink jet print head according to claim 9, wherein said second chamber-carrying member is one of a plurality of chamber-carrying members each having a respective one of said chamber groups formed therein.

11. The ink jet print head according to claim 9, wherein said nozzles of said respective nozzle groups are disposed in an alternating fashion within said single nozzle row.

12. The ink jet print head according to claim 9, wherein said first chamber-carrying member and second chamber-carrying member together form a module, and including at least one further module comprising two mutually adjacent chamber-carrying members, said module and said at least one further module together forming the ink jet print head.

13. The ink jet print head according to claim 9, including further chamber-carrying members forming an ink jet print head module together with said first chamber-carrying member, and wherein only said first chamber-carrying member has said nozzles formed therein.

14. The ink jet print head according to claim 9, including a spacer member, said first chamber-carrying member, said second chamber-carrying member and said spacer member forming a print head module, said print head module including an ink supply opening and having a suction chamber formed therein, said spacer member having an opening formed therein for connecting said ink supply opening to said suction chamber, said spacer member having second and third openings formed therein, said second openings supplying at least one of said $k^{th}$ chamber groups with ink from said suction chamber, said $k^{th}$ nozzle groups communicating with respective ones of said chamber groups through said third openings.

15. The ink jet print head according to claim 12, including a spacer member disposed between said modules, and wherein each of said modules has a suction chamber formed therein, said spacer member having ink supply and ink lead-through openings and a recess for receiving said ink ejection means formed therein, each of said suction chambers communicating with a respective one of said chamber groups through second ink supply openings, and each module having supply openings formed therein for supplying ink to said suction chambers.

16. The ink jet print head according to claim 12, wherein said ink supply openings are elongated openings being one of rectangular, oval and longhole, respective ones of said elongated openings being disposed above one another and being rotated relative to one another by substantially 90°, said elongated openings extending along a first line near an edge face of said module, said first line being offset with regard to a second line of elongated openings disposed below said first line of elongated openings, an offset distance between said first and second lines and a longest lateral distance between said elongated openings being greater than said elongated openings disposed above or below and rotated by substantially 90°, respective ones of said elongated openings together with openings rotated by 90° together defining a cross-section being larger than a cross-section of said nozzles, wherein said second chamber-carrying member is a plurality of second chamber-carrying members each having a suction chamber formed therein, said ink ejecting means being in the form of piezo-electrical elements disposed at said ink chambers.

17. The ink jet print head according to claim 16, wherein said spacer members are formed of the same material as said first chamber-carrying member and said second chamber-carrying member or of the same material as said piezo-electrical elements.

18. An ink jet print head of the edge-shooter type, comprising:

a first chamber-carrying member having a plurality of ink chambers for receiving ink formed in a flat surface thereof;

a second chamber-carrying member having a plurality of ink chambers for receiving ink formed in a flat surface thereof;

a center member disposed between the flat surface of said first chamber-carrying member and the flat surface of said second chamber-carrying member;

one of said first chamber-carrying member and said center member having nozzles formed therein each assigned to a respective one of said ink chambers;

means for ejecting ink from said ink chambers through said nozzles;

said nozzles forming a single nozzle row having $k \geqq 2$ nozzle groups and extending in a first direction, said ink chambers having k chamber groups with each of said nozzle groups being associated with a respective one of said chamber groups;

said ink chambers formed in said first chamber-carrying member being a first chamber group and said ink chambers formed in said second chamber-carrying member being a $k^{th}$ chamber group, a first nozzle group of said k nozzle groups communicating with said first chamber group, and a $k^{th}$ nozzle group of said k nozzle groups communicating with said $k^{th}$ chamber group;

said nozzle openings extending and ejecting ink droplets in a second direction being substantially orthogonal to said first direction, said k chamber groups being disposed in a third direction relative to one another, said third direction being substantially orthogonal to said first direction and to said second direction; and said center member having communication openings formed therein, said communication openings being associated and cooperating with said ink supplying means for supplying said $k^{th}$ nozzle group in said nozzle row with ink.

19. The ink jet print head according to claim 18, wherein said second chamber-carrying member is one of a plurality of chamber-carrying members each having a respective one of said chamber groups formed therein.

20. The ink jet print head according to claim 18, wherein said nozzles of said respective nozzle groups are disposed in an alternating fashion within said single nozzle row.

21. The ink jet print head according to claim 18, wherein said first chamber carrying member, said second chamber-carrying member, and said center member together form a module having a middle region and an edge region, said nozzles being formed in an edge surface of said first chamber-carrying member, and said edge surface being disposed in one of said middle and edge regions.

22. The ink jet print head according to claim 18, wherein said first chamber carrying member, said second chamber-carrying member, and said center member together form a module, and including at least one further module comprising two chamber-carrying members and a center member disposed therebetween, said module and said at least one further module together forming the ink jet print head.

23. The ink jet print head according to claim 18, including further chamber-carrying members and at least one further center member disposed between respective ones of said further chamber-carrying members, said chamber-carrying members and said center members together forming an ink jet print head module with only said first chamber-carrying member having said nozzles formed therein.

24. The ink jet print head according to claim 18, including spacer members, said chamber-carrying members, said center member and said spacer members forming a print head module, said print head module including an ink supply opening and having a suction chamber formed therein, at least one of said center member and said spacer members having an opening formed therein for connecting said ink supply opening to said suction chamber, at least one of said center member and said spacer members having second and third openings formed therein, said second openings supplying at least one of said $k^{th}$ chamber groups with ink from said suction chamber, said $k^{th}$ nozzle groups communicating with respective ones of said chamber groups through said third openings.

25. The ink jet print head according to claim 22, including a spacer member disposed between said modules, and wherein each of said modules has a suction chamber formed therein, said spacer member having ink supply and ink lead-through openings and a recess for receiving said ink ejection means formed therein, each of said suction chambers communicating with a respective one of said chamber groups through second ink supply openings, and each module having supply openings formed therein for supplying ink to said suction chambers.

26. The ink jet print head according to claim 22, wherein said ink supply openings are elongated openings being one of rectangular, oval and longhole, respective ones of said elongated openings being disposed above one another and being rotated relative to one another by substantially 90°, said elongated openings extending along a first line near an edge face of said module, said first line being offset with regard to a second line of elongated openings disposed below said first line of elongated openings, an offset distance between said first and second lines and a longest lateral distance between said elongated openings being greater than said elongated openings disposed above or below and rotated by substantially 90°, respective ones of said elongated openings together with openings rotated by 90° together defining a cross-section being larger than a cross-section of said nozzles, wherein said second chamber-carrying member is a plurality of second chamber-carrying members each having a suction chamber formed therein, said ink ejecting means being in the form of piezo-electrical elements disposed at said ink chambers, said center members and said chamber-carrying members being formed of the same material.

27. The ink jet print head according to claim 26, wherein said spacer members are formed of the same material as said center and chamber-carrying members or of the same material as said piezo-electrical elements.

* * * * *